US005398108A

United States Patent [19]

Morinaga et al.

[11] Patent Number: 5,398,108

[45] Date of Patent: Mar. 14, 1995

[54] SHEET SUPPLYING APPARATUS HAVING A PLURALITY OF PRESSURIZING MEANS

[75] Inventors: Kazuyuki Morinaga, Yokohama; Sumitoshi Sootome, Yachiyo; Hisayuki Tomura, Machida, all of Japan

[73] Assignee: Canon Kabushiki Kaisha, Tokyo, Japan

[21] Appl. No.: 849,615

[22] Filed: Mar. 10, 1992

[30] Foreign Application Priority Data

Mar. 11, 1991 [JP] Japan ..... 3-072368
Mar. 11, 1991 [JP] Japan ..... 3-072370
Mar. 11, 1991 [JP] Japan ..... 3-072374

[51] Int. Cl.[6] ..... G03G 21/00

[52] U.S. Cl. ..... 355/309; 355/72; 271/127; 271/160

[58] Field of Search ..... 355/309, 72, 308, 311, 355/317; 271/160, 127, 126; 346/134, 140 R

[56] References Cited

U.S. PATENT DOCUMENTS 5,002,266 3/1991 Kikuchi et al. ..... 271/127 X
5,019,839 5/1991 Watanabe et al. ..... 346/140 R X
5,020,788 6/1991 Hatano et al. ..... 271/126

FOREIGN PATENT DOCUMENTS 330276 8/1989 European Pat. Off. ..... 271/160
2939342 7/1980 Germany .
63-87424 4/1988 Japan ..... 271/160

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A sheet supplying apparatus having sheet container for stacking and supporting sheets, and sheet supplying device for feeding out the sheet contained in the sheet container by applying a feeding force to the sheet. Sheet container includes a shiftable intermediate plate on which the sheets are stacked and a plurality of pressurizing members for biasing the intermediate plate toward the sheet supplying device to urge the sheets stacked on the intermediate plate against the sheet supplying device, and each of the pressurizing members being selected in response to the used amount of the sheets stacked on the intermediate plate to apply a biasing force to the intermediate plate.

27 Claims, 23 Drawing Sheets

SHEET SUPPLYING APPARATUS HAVING A PLURALITY OF PRESSURIZING MEANS

BACKGROUND OF THE INVENTION

1. Field of the Invention

The present invention relates to a sheet supplying apparatus for separating and supplying a sheet one by one from a sheet stack, and more particularly, it relates to a structure of a sheet containing portion removably mountable in a sheet feeder portion.

2. Related Background Art

Generally, in sheet supplying apparatuses used with copying machines, printers, facsimiles and the like, a number of sheets (such as transfer sheets, photosensitive sheets and the like) are stacked on a sheet receiving plate of a cassette or deck, and such sheet is separated and supplied one by one from the stacked sheets (sheet stack) by means of a sheet supply means such as sheet supply rollers and the like and is fed toward a next processing station. In this case, to prevent a so-called double-feed, i.e., the fact that two or more sheets are supplied at a time, the provision of separating pawls is already known. More particularly, separating pawls are arranged at a leading end of the sheet stack with respect to a sheet supplying direction, and, when an uppermost sheet is supplied, it rides over the separating pawls while forming a loop at a leading end portion of the uppermost sheet, whereby the uppermost sheet is separated from the other sheets, with the result that only one sheet is supplied.

FIG. 29 is a perspective view of a main portion of an exemplary sheet supplying apparatus having separating pawls. In FIG. 29, the reference numeral 100 denotes a sheet stacking support (intermediate plate) acting as a sheet receiving plate; 101 denotes springs for biasing the sheet stacking support 100 upwardly; P denotes a sheet stack comprised of sheets (cut sheets or papers) having the same size; 102 denotes sheet supply rollers; and 103 denotes a pair of left and right separating pawls disposed on and engaged by front left and right upper corners of the sheet stack P with respect to a sheet supplying direction. An upper surface of the front or leading end portion of the sheet stack P is urged against lower surfaces of the sheet supply rollers 102 with a predetermined pressure by lifting the sheet stacking support by means of the springs 101. Alternatively, the sheet supply rollers 102 may be lowered to urge against the upper surface of the sheet stack P in response to a respective sheet supply signal. Each separating pawl 103 is pivotally mounted on a pin 103*a* for movement in an up-and-down direction so that the pawl is rested on the corresponding front corner of the sheet stack P by its own weight.

When the sheet supply rollers 102 are rotated in the sheet supplying direction, an uppermost sheet P1 of the sheet stack P is subjected to a feeding force directing toward the sheet supplying direction by the friction force between it and the sheet supply rollers 102. Thus, the uppermost sheet P1 tries to advance in the sheet supplying direction; however, since the left and right front corners of the sheet are restrained by the separating pawls 103, the uppermost sheet cannot advance in the sheet supplying direction. As a result, as the sheet supply rollers 102 are rotated, a bent loop E is formed in the uppermost sheet P1 near the separating pawls 103 between the sheet supply rollers 102 and the separating pawls 103 in opposition to the resiliency of the sheet P1. As a result, when the bent loop E grows up to a certain extent, by a restoring force tending to return the bent loop E to the original state, the left and right front corners (retained by the separating pawls 103) of the uppermost sheet P1 naturally shift from lower surface sides to upper surface sides of the separating pawls 103, thus riding over the separating pawls 103. That is to say, by forming and growing the bent loop E in the uppermost sheet P1, the latter is released from the separating pawls 103, with the result that only the uppermost sheet is separated from the other sheets P.

By the way, pursuant to the variety of information and the increase in information dissemination, the amount of sheets to be used has increased. Thus, in order to eliminate the trouble regarding the replenishment of sheets, the sheet stacking ability of the sheet supply cassette has been increased, for example, from 250 sheets to 500 sheets. However, in the above-mentioned sheet supplying apparatus, it was feared that, when the increased sheets were stacked on the intermediate plate 100, as the uppermost sheet of the sheet stack P was separated from the other sheets and fed out by the sheet supply rollers 102, the left and right front corners of the uppermost sheet could not be disengaged from the separating pawls 103, thus causing the poor sheet supply.

That is to say, despite the fact that the smooth supply of the uppermost sheet is greatly influenced upon the urging force of the sheet supply rollers 102 against the uppermost sheet P1, i.e., the lifting force for lifting the intermediate plate 100 (which lifting force relates to the urging force), such lifting force is exclusively dependent upon the feature of the springs 101. Since the proper sheet supply can be affected by the delicate balance between the lifting force against the intermediate plate 100 and the weight of the sheets and of the intermediate plate 100, even if the number of sheets to be stacked is increased without changing the fundamental construction of the sheet supply cassette, abnormal sheet supply will occur frequently.

SUMMARY OF THE INVENTION

Accordingly, an object of the present invention is to provide a sheet supplying apparatus wherein the smooth sheet supply can be effected even when the number of sheets to be stacked is increased, by extending an adjustment range of an urging force against an intermediate plate.

According to the present invention, there is provided a sheet supplying apparatus comprising a sheet containing means for stacking and supporting sheets, and sheet supplying means for feeding out the sheet contained in the sheet containing means by applying a feeding force to the sheet. Sheet containing means includes a shiftable intermediate plate on which the sheets are stacked and a plurality of pressurizing means for biasing the intermediate plate toward the sheet supplying means to urge the sheets stacked on the intermediate plate againt the sheet supplying means, and each of the pressurizing means being selected in response to the used amount of the sheets stacked on the intermediate plate to apply a biasing force to the intermediate plate.

More particularly, the number of the pressurizing means is decreased in accordance with the decrease in the number of sheets stacked in the sheet containing means.

With the arrangement as mentioned above, for example, in a cassette having the maximum sheet stacking ability of 500 sheets, when a large number of sheets are stacked on the intermediate plate, since a larger biasing force for supporting the weight of the sheets and a biasing force (sheet supply pressure) for urging the sheets against the intermediate plate are required, all or almost all of the pressurizing means are used to bias the intermediate plate with a greater force; whereas, when the number of the stacked sheets is small, since only a smaller biasing force for supporting the weight of the sheets is required, a smaller number of the pressurizing means are used to bias the intermediate plate. In this way, even regarding a cassette having the greater sheet stacking ability, it is possible to maintain the sheet supply pressure substantially within the ideal range (300–500 grams), thus eliminating the poor sheet supply and the like.

According to another aspect of the present invention, there is provided a sheet supplying apparatus comprising a sheet containing means for stacking and supporting sheets, and sheet supplying means for feeding out the sheet contained in the sheet containing means by applying a feeding force to the sheet. Sheet containing means includes a shiftable intermediate plate on which the sheets are stacked and a plurality of pressurizing means for biasing the intermediate plate toward the sheet supplying means to urge the sheets stacked on the intermediate plate against the sheet supplying means, and the pressurizing means comprising a first pressurizing means for always biasing the intermediate plate, and second pressurizing means capable of being switched between an intermediate plate biasing condition and a non-biasing condition.

More particularly, the second pressurizing means biases the intermediate plate when the sheet supplying means is in a sheet supplying condition, and does not bias the intermediate plate when the sheet supplying means is in a non-sheet supplying condition.

With the arrangement as mentioned above, for example, in a cassette having the maximum sheet stacking ability of 500 sheets, when new sheets are replenished, since the intermediate plate is biased only by the first pressurizing means, the sheets can easily be inserted by easily depressing the intermediate plate, thus improving the operability. Further, in the sheet supplying operation, since the intermediate plate is biased toward the sheet supplying means by the first and second pressurizing means, it is possible to obtain the stable sheet supply pressure, thus reducing or eliminating the poor sheet supply.

BRIEF DESCRIPTION OF THE DRAWINGS

FIG. 21C is a view showing a construction for keeping the length L3 constant;

DETAILED DESCRIPTION OF THE PREFERRED EMBODIMENTS

Figure 1:
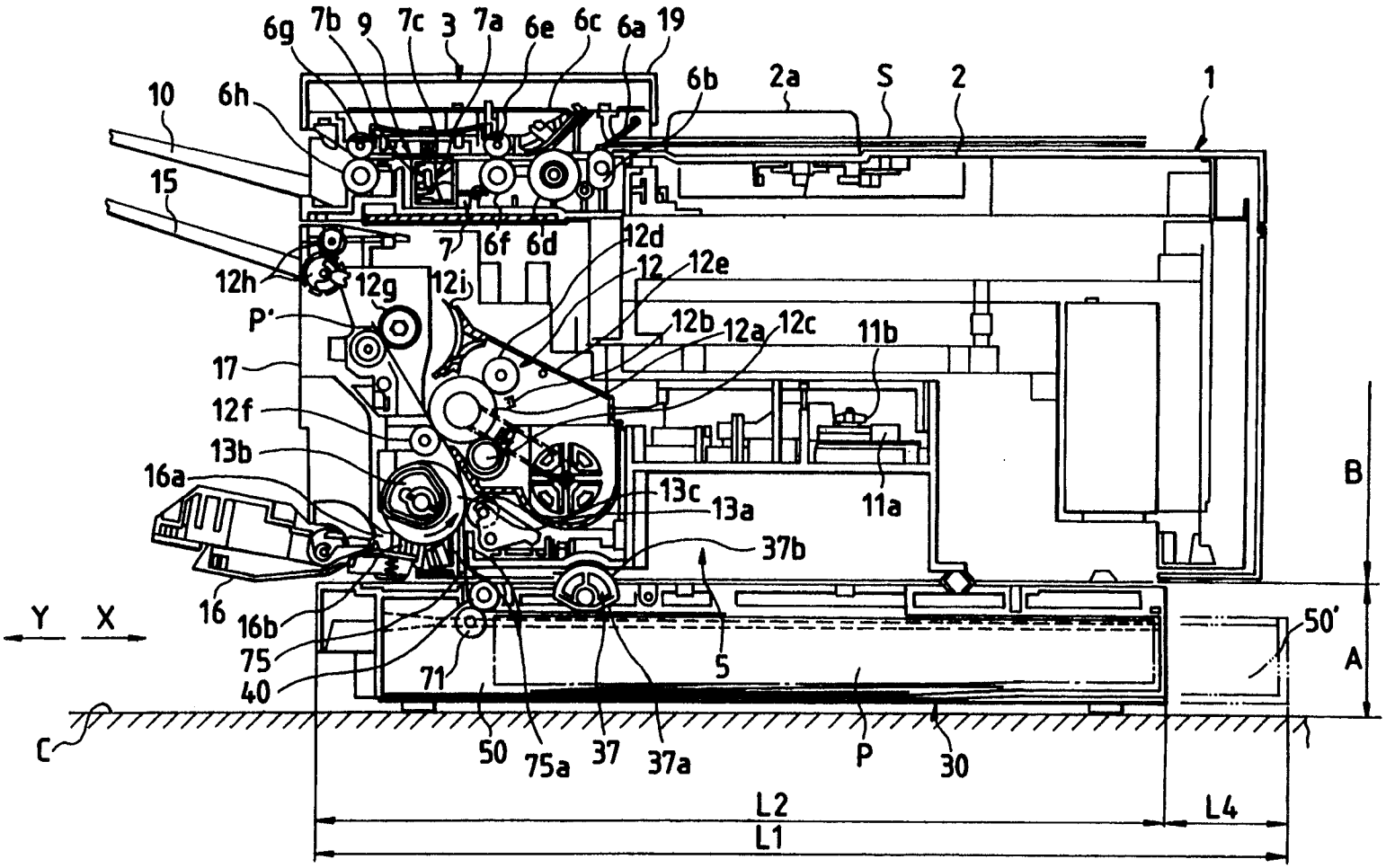
FIG. 1 is an elevational sectional view of a facsimile to which the present invention is applied.

First of all, the whole construction of a facsimile system embodied as a preferred embodiment according to the present invention will be briefly explained with reference to FIGS. 1.and 2. An original stacking plate 2 capable of stacking a plurality of originals S is formed on an upper surface of a facsimile system 1. An optical reading system 3 for reading image information recorded on the original fed from the original stacking plate 2 is arranged at one end (left end in FIG. 1) of the upper surface of the facsimile system 1, and a recording system 5 comprising a laser beam printer is disposed below the optical reading system 3. Further, a telephone 26, an operation panel 27 and the like are also arranged on the upper surface of the facsimile system 1.

The optical reading system 3 operates in such a manner that the originals S stacked on the original stacking plate 2 are separated one by one by means of a preliminary convey roller 6*b* urged against a preliminary convey urging member 6*a* and a separation roller 6*d* urged against a separation urging member 6*c*, and the separated original is sent to a contact sensor (sensor of contact type) 7 by means of a main convey roller 6*f* urged against an original feed roller 6*e*, and the image information recorded on the original S is read while closely contacting the original with the contact sensor 7 by means of an urging means 9. Thereafter, the original is ejected onto an original ejection tray 10 by means of ejector rollers 6*g*, 6*h*. The contact sensor 7 operates in such a manner that light from an LED 7*a* acting as a light source is illuminated on the image information surface of the original S and the image information is read by focusing the reflected light reflected from the image information surface onto a photoelectric converting element 7*c* by means of a short focus focusing lens 7*b*. The read image information is sent to a recording portion of another facsimile in case of a facsimile mode, or is sent to the recording system 5 in case of a copy mode.

Incidentally, a slider 2*a* is mounted on the original stacking plate 2 for sliding movement in a direction (along a width of the original) transverse to an original feeding direction, so that both lateral edges of the originals S rested on the original stacking plate 2 can be registered with each other by the slider 2*a*. Further, the recording system 5 includes a laser beam generator 11*a* which emits a signal (beam) modulated on the basis of an image signal from the contact sensor 7. The modulated beam is reflected by a polygonal mirror 11*b* to illuminate a photosensitive drum 12*a* of an image forming portion 12 as scanning light, thereby forming an image corresponding to the image information on the photosensitive drum 12*a*. The image formed on the drum is transferred onto a recording sheet P fed from a sheet supply portion A to the image forming portion 12, and then is fixed to the recording sheet. Thereafter, the recording sheet is ejected out of the facsimile system.

The photosensitive drum 12*a* is incorporated into a recording cartridge 12*e*, together with a primary charger 12*b*, a developing roller 12*c* and a cleaning roller 12*d* to form a unit which can be removably mounted within the facsimile system 1. A surface of the photosensitive drum 12*a* is uniformly charged by the primary charger 12*b*. When the scanning light from the polygonal mirror 11*b* is illuminated on the surface of the photosensitive drum 12*a*, a latent image is formed on the drum, which latent image is developed with toner supplied from the developing roller 12*c* to visualize the image as a toner image.

A transfer charger 12*f* is disposed around the photosensitive drum 12*a* of the image forming portion 12, and fixing rollers 12*g* and ejector rollers 12*h* are disposed in a recording sheet feeding path at a downstream side of the photosensitive drum 12*a*. After the toner image formed on the photosensitive drum 12*a* is transferred onto the recording sheet P fed from the sheet supply portion A by means of the transfer charger 12*f*, the toner image is fixed to the recording sheet P by means of the fixing rollers 12*g*, and then, the recording sheet is ejected, by means of the ejector rollers 12*h*, onto an ejection tray 15 removably mounted on the facsimile system 1 at one side (left side in FIGS. 1 and 2) thereof.

Further, a stacking tray 16 for manual supply sheets is arranged at one end of the facsimile system 1 for opening and closing movement. When the stacking tray 16 is opened in a substantially horizontal position, a manual sheet supply opening 16*a* is opened. In this condition, when a recording sheet P is rested on the stacking tray 16 and is inserted into the manual sheet supply opening 16*a*, the recording sheet P is urged against a larger diameter roller 13*b* of a pair of feed rollers 13*a* by means of an urging member 16*b*, so that the recording sheet is separated one by one by the roller 16*b*. Then, the recording sheet is fed between the transfer charger 12*f* and the photosensitive drum 12*a* by the paired feed rollers 13*a*.

Incidentally, an openable lid 17 is mounted at one end of the facsimile system 1, and the above-mentioned stacking tray 16 is formed on the lid 17 and the ejection tray 15 is removably attached to the lid. Further, by opening the lid 17, the recording cartridge 12*e* can be inserted into or dismounted from the facsimile system 1. Further, the openable lid 17 is operable in synchronous with a movement of a drum photosensitivity preventing shutter 12*i* formed on the recording cartridge 12*e*, so that when the lid 17 is opened the shutter 12*i* is closed and when the lid 17 is closed the shutter 12*i* is opened.

Further, although not shown, an operation button for release lever for releasing a locking condition of the openable lid 17 is arranged in a recess formed in a front surface of the lid 17, and the recess is closed by a protection cover integrally formed with the ejection tray 15, so that the locking condition of the lid 17 cannot be released by the operation button so long as the ejection tray 15 is not detached from the lid 17. Thus, it is possible to prevent the recording cartridge 12*e* from being damaged, which cartridge otherwise will be damaged when the recording cartridge 12*e* is exchanged in a half-open condition of the openable lid 17 which occurs if the lid is not opened completely due to the obstruction of the ejection tray 15. Further, it is also possible to prevent the photosensitive drum from being exposed due to the half-open condition of the lid 17 and accordingly the shutter 12*i*, thus preventing the deterioration of the image quality.

In the sheet supply portion A, the recording sheet P is separated, by means of semi-circular sheet supply rollers 37, one by one from the other sheets in a sheet supply cassette 50 retractably mounted within a lower portion of the facsimile system 1 and is fed to a pair of convey rollers (regist rollers) 37. The paired regist rollers 37 feed the recording sheet P between the transfer charger 12*f* and the photosensitive drum 12*a* via the feed rollers 13*a* with a sheet supply timing that a leading end of the toner image formed on the photosensitive drum 12*a* is in registration with a leading end of the recording sheet P.

Although the number of the sheets to be stacked in the sheet supply cassette may be about 250 in the copying machine, in the facsimile system, about 500 sheets should be stacked in the cassette because the facsimile system is always in the power-on condition so that the facsimile system can receive the information from abroad overnight and can receive the information during a long-term vacation and because an operator does not always monitor the facsimile system. Further, the sheet supplying apparatus should have the performance higher than that of the copying machine.

Figure 3:
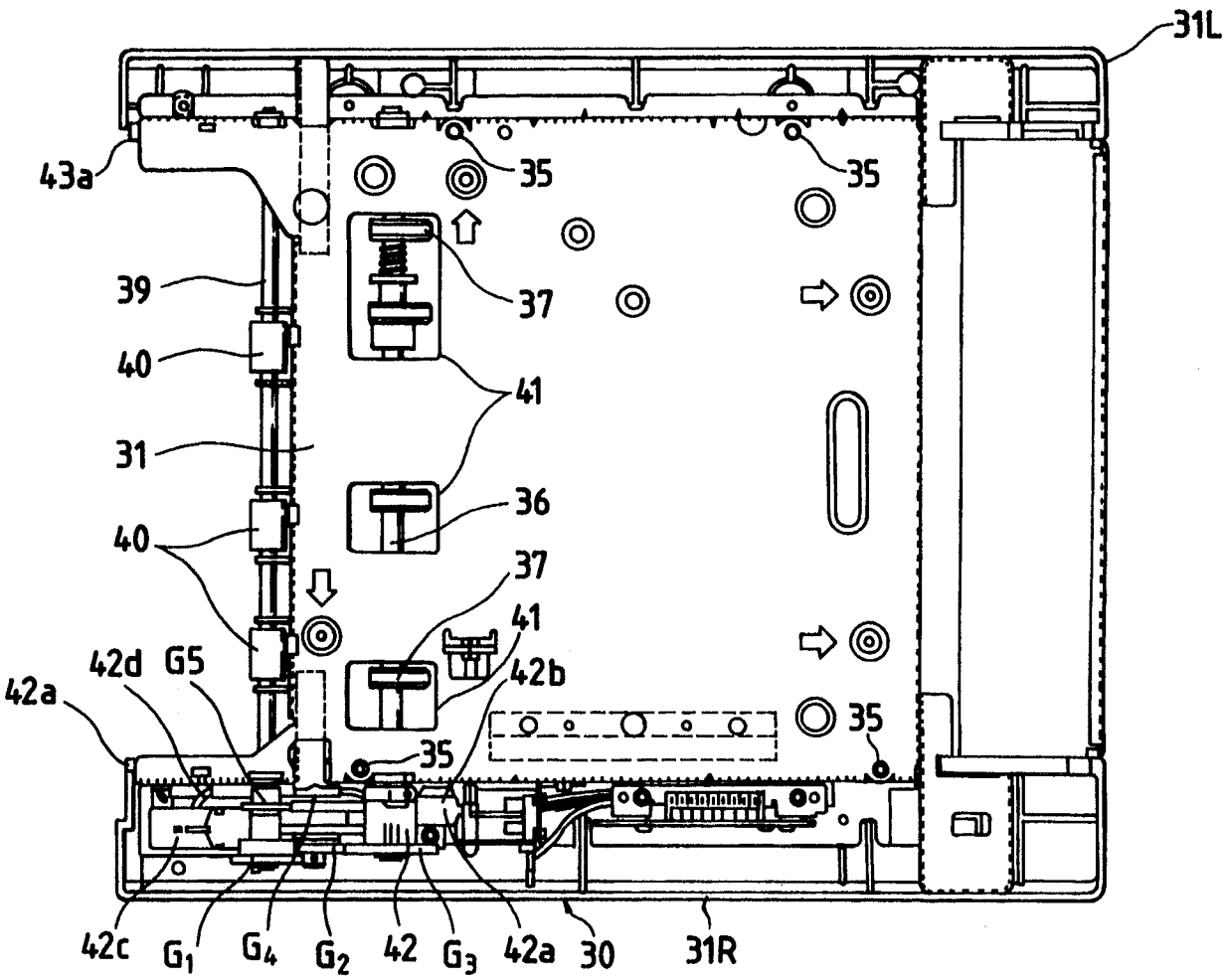
FIG. 3 is a plan view of a sheet feeder.
Figure 4:
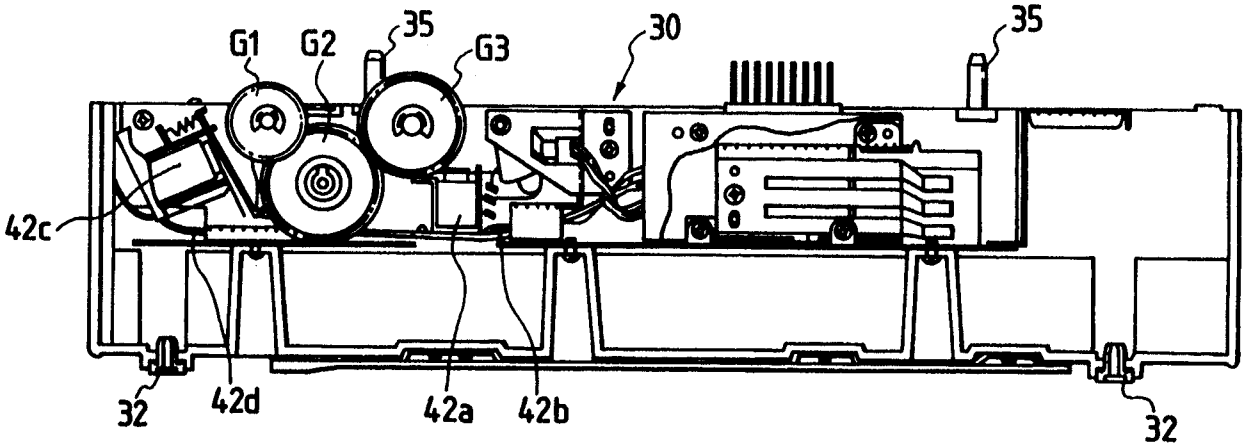
FIG. 4 is an elevational sectional view of a driving portion of the sheet feeder.
Figure 5:
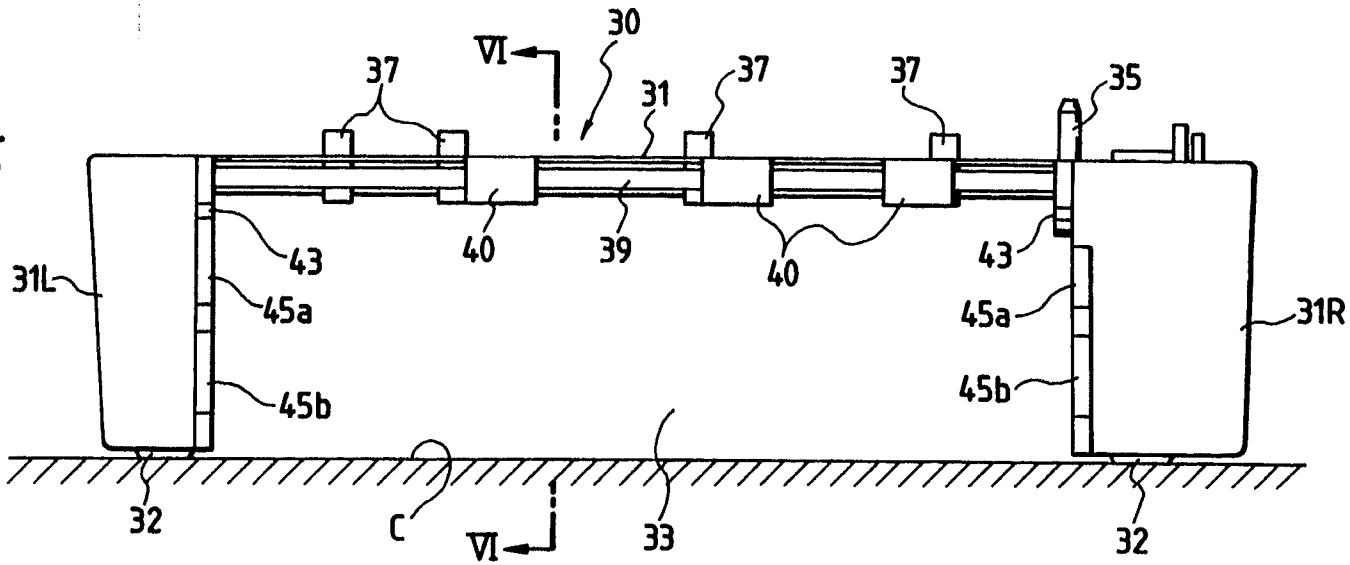
FIG. 5 is an end view of the sheet feeder.
Figure 6:
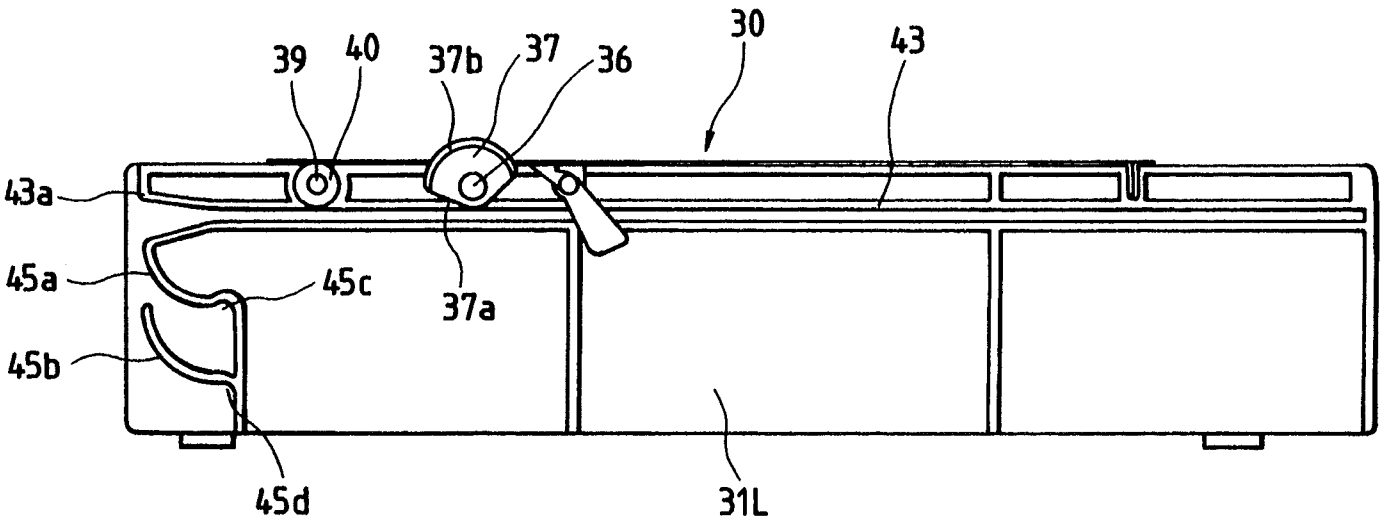
FIG. 6 is an elevational sectional view of the sheet feeder.

FIG. 3 is a plan view of a sheet feeder 30 according to the present invention, FIG. 4 is an elevational sectional view of a driving portion of the sheet feeder, FIG. 5 is an end view of the sheet feeder, and FIG. 6 is an elevational sectional view of the sheet feeder taken along the line VI—VI in FIG. 5.

In FIGS. 3–6, the sheet feeder 30 comprises a top plate 31, left and right hollow pedestals 31L, 31R attached to left and right lateral edges of the top plate 31 and extending in parallel with each other in a front and rear direction, and rubber foots 32 secured to the bottom of the pedestals. When the feeder 30 is rested on an installation platform C, a sheet supply cassette containing space 33 (FIG. 5) is defined by a lower surface of the top plate 31 of the feeder, an upper surface of the installation platform C and inner surfaces of the left and right pedestals 31L, 31R. Positioning bosses 35 formed on the top plate 31 of the feeder are adapted to be fitted into positioning holes formed in the lower surface of a facsimile B, so that a sheet supplying apparatus A is connected to the facsimile B when the latter is positioned and rested on the feeder 30. Incidentally, the reference numeral 36 denotes a sheet supply roller shaft rotatably supported between the left and right pedestals 31L, 31R; and 37 denotes four rollers (sheet supply means) secured to the roller shaft 36 at a predetermined interval. In the illustrated embodiment, each sheet supply roller 37 is a semi-cylindrical roller (D-cut roller) having a flat cut-out 37*a*. The sheet supply rollers 37 are normally kept stationary so that the flat cut-outs of the rollers face downwardly (FIGS. 1 and 6). The reference numeral 39 denotes a sheet feed roller shaft rotatably supported between the left and right pedestals 31L, 31R; and 40 denotes feed rollers secured to the roller shaft 39.

The sheet supply roller shaft 36 extends substantially in parallel with the sheet feed roller shaft 39, and the latter is positioned near the leading end of the top plate 31 of the feeder and the sheet supply roller shaft 36 is positioned at an upstream side of the sheet feed roller shaft 36 in a sheet supplying direction. Cylindrical surface portions 37*b* (opposite to the respective flat cut-out 37*a*) of the sheet supply rollers 36 are partially protruded above the top plate 31 through corresponding through holes 41 formed in the latter.

Gears G1–G5 constitute a gear train wherein the gear G1 is freely mounted on the sheet feed roller shaft 39 at a right side thereof and acts as an input gear for transmitting a driving force from the facsimile system, the gear G2 is an idle gear, the gear G3 is freely mounted on the sheet supply roller shaft 36 at the right side thereof and acts as a clutch gear controlled by a one-revolution clutch 42 so as to be connected to or disconnected from the sheet supply roller shaft 36, the gear G4 is freely mounted coaxially with the gear G2 and acts as a clutch gear controlled by a clutch 42 so as to be connected to or disconnected from the gear G2, and the gear G5 is positioned at the left side of the input gear G1 and acts to as a feed roller shaft gear secured to the sheet feed roller shaft 39 (FIG. 3).

When a cassette drive means of the facsimile system is turned ON, the input gear G1 is rotated in a clockwise direction to rotate the gears G2, G3. The idle gear G2 and the clutch gear G4 are rotated in an counterclockwise direction, and the clutch gear G3 and the feed roller shaft gear G5 are rotated in a clockwise direction. When an electromagnetic solenoid plunger 42*a* of the spring clutch 42 is turned OFF, the clutch gear G4 is disconnected from the sheet supply roller shaft 36 because of the clutch-off condition, with the result that the gear G4 is freely rotated on that shaft 36. Thus, in this condition, the rotational force is not transmitted to the sheet supply roller shaft 36, thereby keeping the sheet supply rollers 37 stationary. When the electromagnetic solenoid plunger 42*a* is temporarily turned ON, the spring clutch 42 is changed to the clutch-on condition, so that the clutch gear G3 is connected to the sheet supply roller shaft 36, thereby rotating the latter in the clockwise direction, with the result that the sheet supply rollers 37 are rotated in a clockwise direction (FIGS. 1 and 6). When the sheet supply roller shaft 36 and accordingly the sheet supply rollers 37 are rotated by one revolution (360°), the clutch-off condition is restored, thereby stopping the sheet supply roller shaft 36 and accordingly the sheet supply rollers 37.

When an electromagnetic solenoid plunger 42*c* of the spring clutch 42 is turned OFF, the clutch gear G4 is disconnected from the gear G2 because of the clutch-off condition, thereby being kept stationary. Thus, in this condition, the rotational force is not transmitted to the feed roller shaft gear G5, thus keeping the sheet feed rollers 40 stationary. When the electromagnetic solenoid plunger 42*c* is turned ON, the spring clutch 42 is changed to the clutch-on condition, with the result that the clutch gear G4 is connected to the idle gear G2, thereby rotating the feed roller shaft gear G5 in the clockwise direction. Accordingly, the sheet feed rollers 40 are rotated in the clockwise direction.

The reference numeral 42*b* and 42*d* denote lead wires for the elctromagnetic solenoid plungers 42*a*, 42*c*. When the facsimile B is properly rested on the sheet supplying apparatus A, an electric coupling member (not shown) of the sheet supplying apparatus A is coupled to an electric coupling member (not shown) of the facsimile B, so that the electromagnetic solenoid plungers 42*a*, 42*c* are connected to a control circuit (not shown) of the facsimile B via the lead wires 42*b*, 42*d*. Alternatively, after the facsimile B is properly rested on the sheet supplying apparatus A, when plugs (not shown) provided at terminal ends of the lead wires 42*b*, 42*d* are inserted into sockets (not shown) of the facsimile B, the electromagnetic solenoid plungers 42*a*, 42*c* may be connected to the control circuit of the facsimile B. Incidentally, the reference numeral 43 (FIGS. 5 and 6) denotes guide grooves for guiding the sheet supply cassette during the insertion and retraction movement of the cassette, which grooves are formed symmetrically in the inner surfaces of the left and right pedestals 31L, 31R, respectively, to extend in a longitudinal direction; and 45*a* and 45*b* denote cam grooves formed symmetrically in the inner surfaces of the left and right pedestals 31L, 31R at their leading portions.

Figure 7:
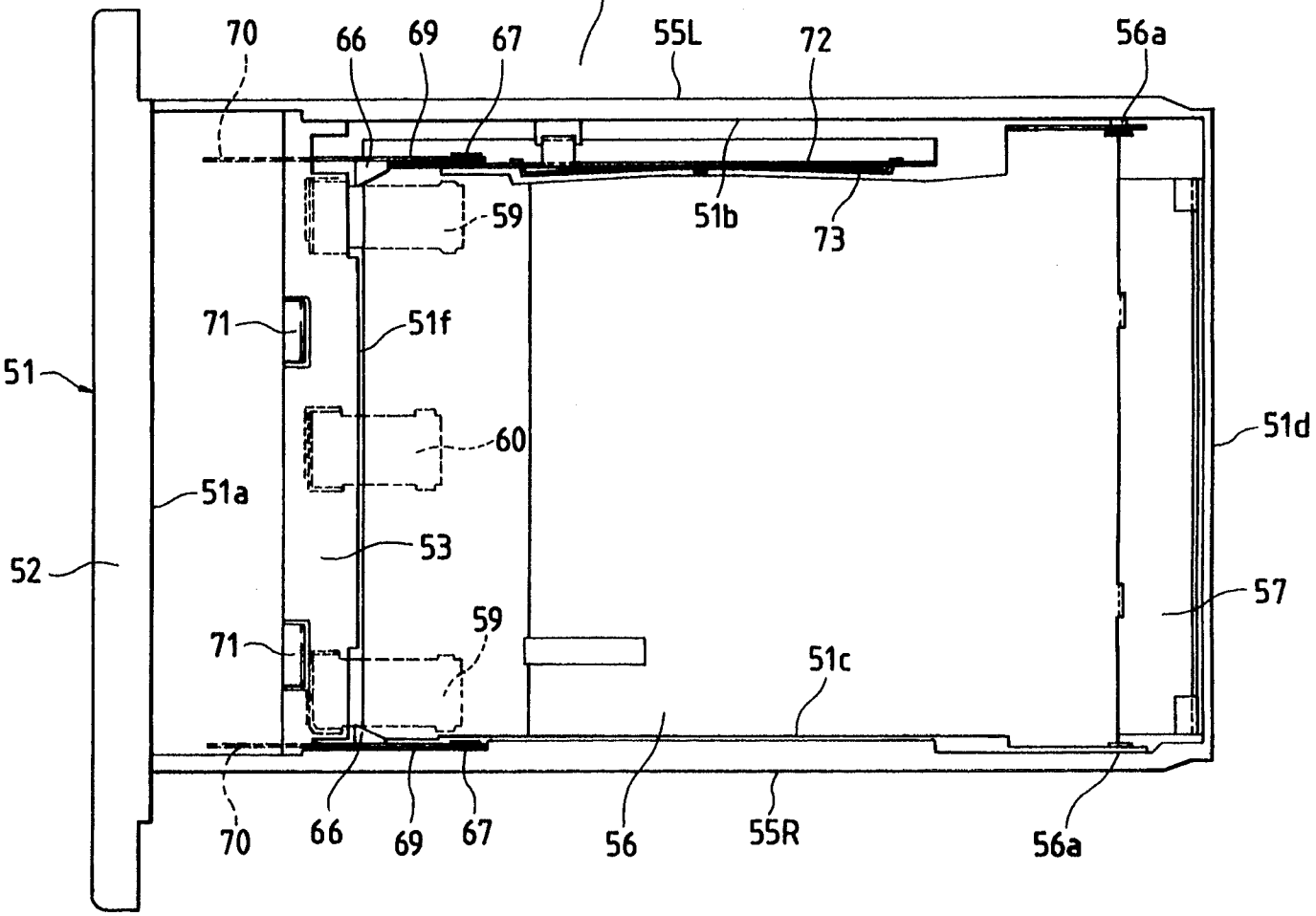
FIG. 7 is a plan view of a sheet supply cassette.
Figure 8:
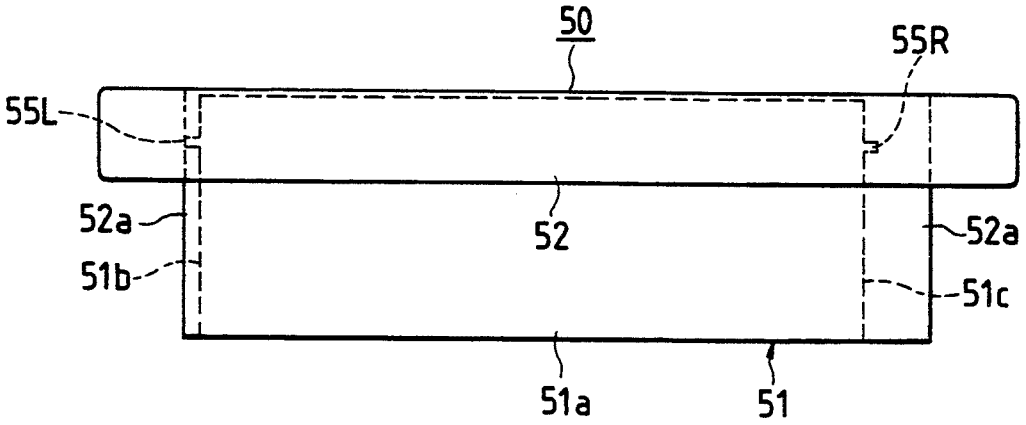
FIG. 8 is a front end view of the sheet supply cassette.
Figure 9:
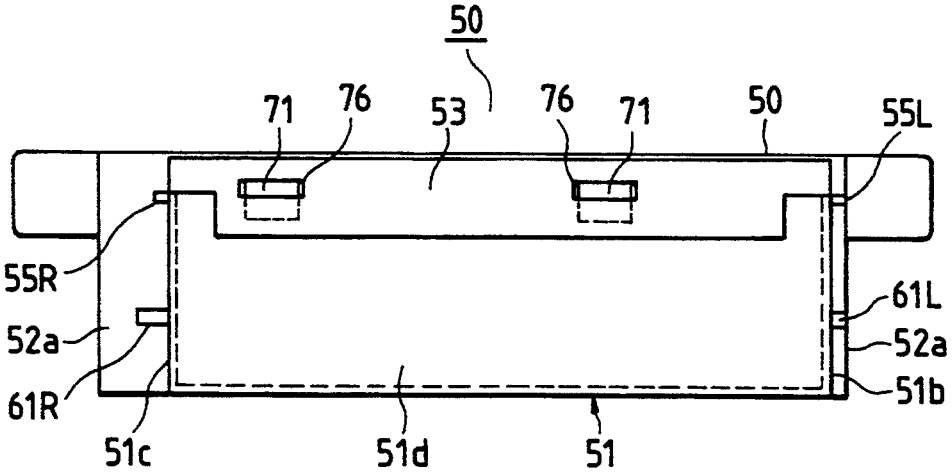
FIG. 9 is a rear end view of the sheet supply cassette.
Figure 10:
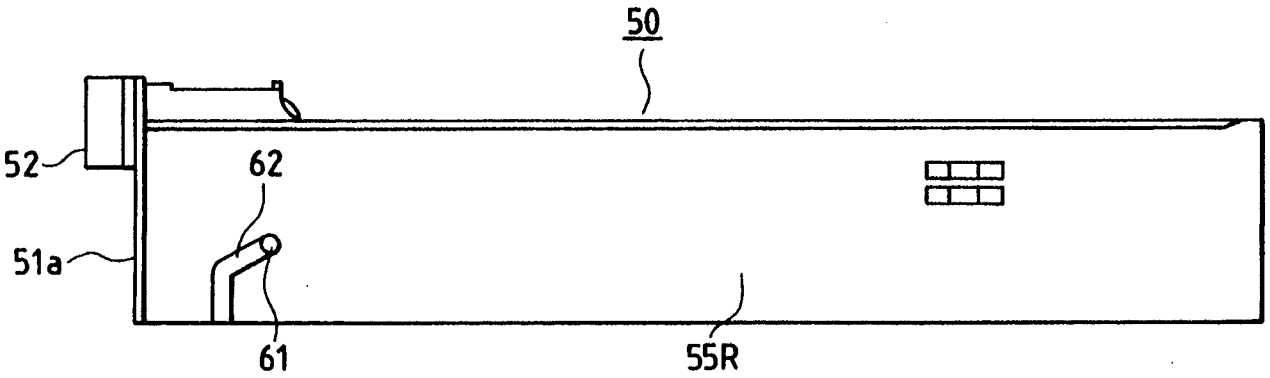
FIG. 10 is an elevational view of the sheet supply cassette.
Figure 11:
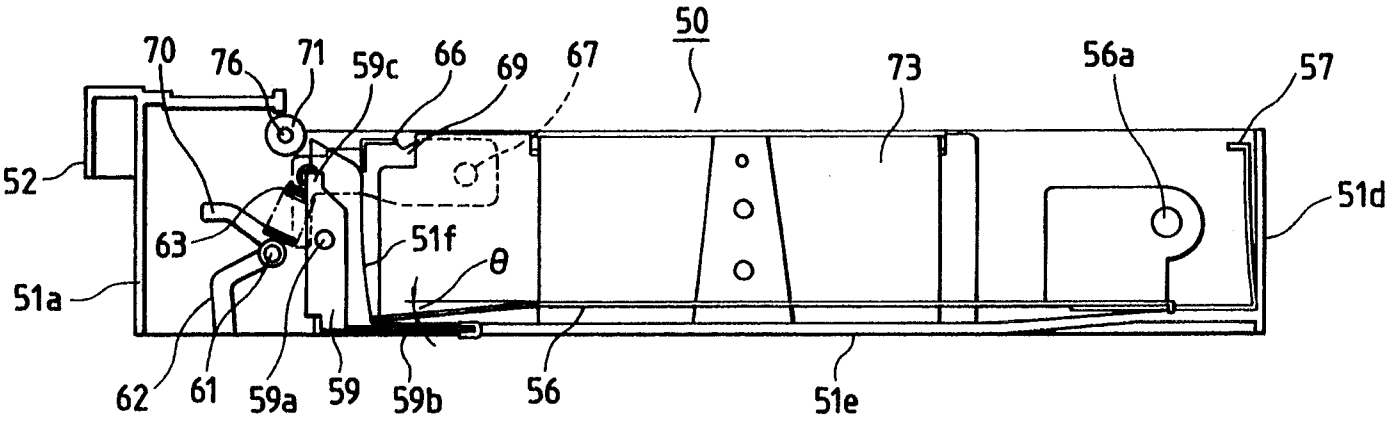
FIG. 11 is an elevational sectional view of the sheet supply cassette.

FIG. 7 is a plan view of the sheet supply cassette 50, FIG. 8 is a front end view of the cassette, FIG. 9 is a rear end view of the cassette, FIG. 10 is a right elevational view of the cassette, and FIG. 11 is an elevational sectional view of the cassette.

The sheet supply cassette 50 comprises a body case 51 having an open upper end and having a rectangular horizontal section, which body case includes a front wall 51*a*, a left side wall 51*b*, a right side wall 51*c*, a rear wall 51*d*, a bottom wall 51*e* and a sheet (leading end) abutting wall 51*f*. The reference numeral 52 denotes a gripper formed on an outer surface of the front wall 51*a* of the body case; 53 denotes a sheet guide plate formed on an inner surface of the front wall 51*a* and inclined forwardly and upwardly; 55L, 55R denote elongated flanges formed on and protruded outwardly from the left and right side walls 51*b*, 51*c* of the body case at their upper ends along the longitudinal direction thereof. The body case 51 (walls 51*a*–51*f*), gripper 52, guide plate 53 and left and right elongated flanges 55L, 55R are formed as a one-piece member molded from resin. Particularly, the right side wall 51*c* and the sheet abutting wall 51*f* which are contacted with the sheet are coated by layers made of low friction resin such as 4-fluoride resin or are molded from 4-fluoride resin so as to minimize the sliding resistance between these elements and the sheets and improve their performances.

An intermediate plate 56 is housed in the body case 51 and is pivotally mounted on pins 56*a* at its rear end so that a front end of the plate can be rocked in an up-and-down direction. A trailing end regulating plate 57 is connected to the intermediate plate 56 within the body case 51 so that it can be displaced in response to the up-and-down pivotal movement of the front end of the intermediate plate 56. The sheets P are housed in the body case 51 while being stacked on the intermediate plate 56.

The reference numerals 59, 60 (FIGS. 7 and 11) denote L-shaped pressurizing levers for rocking the intermediate plate 56 in the up-and-down direction. The pressurizing levers 59, 60 are pivotally mounted on shafts 59*a*, 60*a* disposed ahead of the front end of the intermediate plate 56, and horizontal arms 59*b*, 60*b* of the levers 59, 60 are disposed below the front end of the intermediate plate 56 so that, when the pressurizing levers 59, 60 are rotated around the shaft 59*a*, 60*a* in counterclockwise direction, the horizontal arms 59*b*, 60*b* are cocked to rotate the intermediate plate 56 around the pins 56*a* in the upward direction. Free end portions of the horizontal arms of the pressurizing levers 59, 60 are constituted by low friction resin material such as oleo-plastic or 4-fluoride resin so as to minimize the sliding resistance between the pressurizing levers 59, 60 and the intermediate plate 56, so that the pressurizing force from the pressurizing levers 59, 60 can be effectively transmitted to the intermediate plate 56.

A pressurizing shaft 61 disposed ahead of the pressurizing levers 59, 60 has left and right ends 61L, 61R fitted into vertical and inclined slots 62 formed symmetrically in the left and right side walls 51*b*, 51*c* of the body case 51, respectively; the left and right ends 61L, 61R of the shaft 61 are protruded outwardly from the left and right side walls 51*b*, 51*c* (FIGS. 9 and 10). Tension coil springs (first pressurizing members) 63, 65 are connected between the pressurizing shaft 61 and vertical arms 59*c*, 60*c* of the levers 59, 60. In a condition that the sheet supply cassette 50 is dismounted from the sheet feeder 30 (FIG. 11), the pressurizing levers 59, 60 are biased to be rotated around the shaft 59*a*, 60*a* in the clockwise direction by the weight of their horizontal arms 59*b*, 60*b* so that the horizontal arms 59*b*, 60*b* are laid substantially in the horizontal plane. In this condition, the pressurizing shaft 61 is subjected to a tension force from the vertical arms 59*c*, 60*c* of the pressurizing levers 59, 60 via the coil springs 63, 65 so that the left and right ends 61L, 61R of the shaft are lifted up to upper ends of the slots 62 and are held there.

A pair of left and right separating pawls 66 for separating sheets one by one are formed on top ends of pivot levers 69 mounted for pivotal movement in an up-and-down direction around corresponding pins 67 formed on the left and right front inner end portions of the body case 51. The pair of left and right separating pawls 66 are associated with left and right front corners of an uppermost sheet of the sheet stack P rested on the intermediate plate 56 in the body case 51, respectively. The reference numeral 70 denotes lever extensions extending from the front ends of the pivot levers 69 forwardly ahead of the corresponding separating pawls 66. The lever extensions 70 are positioned above the pressurizing shaft 61. In the condition of FIG. 11 wherein the sheet supply cassette 50 is dismounted from the sheet feeder 30, the lever extensions 70 are rested on the pressurizing shaft 61 which is held in the top ends of the slots 62, so that the pivot levers 69 are maintained in a substantially horizontal rest postures and the further downward pivotal movements of the pivot levers are prevented.

Rollers (sheet feed members) 71 are arranged above the forwardly and upwardly inclined guide plate 53 and are rotatably mounted on a shaft 76. The sheet feed rollers 71 act as driven rollers associated with sheet feed rollers (driving rollers) 40 of the sheet feeder 30. As shown in FIG. 1, when the sheet supply cassette 50 is completely inserted into the sheet feeder 30, the driven rollers 71 are engaged by the driving rollers 40 of the sheet feeder 30. The rollers 71 are urged against the driving rollers 40 with a predetermined pressure by means of biasing members (not shown).

The reference numeral 72 (FIG. 7) denotes a side regulating plate for regulating one lateral side (edge) of the sheet stack. The side regulating plate 72 is disposed inside the left side wall 51*b* of the body case 51 and has a bottom portion inserted into a recess 51*e* formed in the bottom of the cassette and an upper portion inserted into an insertion portion of the left side wall 51*b* of the body case 51, so that it serves to maintain the dimension of the inner sheet stacking space stably regardless of the number of the sheets. A biasing spring 73 serves to properly urge the side regulating plate against the lateral surface of the sheet stack. An urging force of the biasing spring 73 for urging the regulating plate against the sheet stack P is selected to have a value of 110±30 grams. If the urging force is smaller than the above value, the side regulating plate cannot be properly positioned, thus causing the skew-feed of the sheet during the sheet supplying operation; whereas, if the urging force is greater than the above value, the urging force resists the pivotal movement of the intermediate plate 56 not to obtain the proper sheet supplying pressure, thus causing the poor sheet supply. Even if the poor sheet supply does not occur, the edge of the sheet will be bent or damaged.

The sheets P are loaded in the sheet supply cassette 50 through the upper opening of the body case 51 in a condition that the cassette 50 is dismounted from the feeder 30 as will be described later. As shown in FIG. 11, in the condition that the cassette 50 is dismounted from the feeder 30, the cassette is balanced with the biasing forces of the compression coil springs 65*a*. Further, the separating pawls 66 are positioned and held within the body case 51 near the upper opening thereof since the lever extensions 70 of the pivot levers 69 having the separating pawls are rested on the pressurizing shaft 61 held at the top ends of the inclined slots 62 to position the levers 69 in the horizontal rest position and to prevent the further downward pivotal movements of the levers. Accordingly, in loading the sheets P in the body case 51, when the sheets P are rested on the intermediate plate 56, the weight of the sheets P lowers the intermediate plate 56 in opposition to the biasing forces of the compression coil springs 65*a*. Thus, the sheet loading or stacking operation can be effected easily and quickly without lowering the intermediate plate 56 by hand.

Incidentally, in the case of the conventional cassette as shown in FIG. 31, the separating pawls 103 urged upwardly and held at the uppermost position by the leading end of the intermediate plate 100 or the leading end of the sheet stack rested on the intermediate plate which is always biased upwardly by the springs 101. Accordingly, when the new sheets P are replenished or loaded in a body case (not shown), since the operator must replenish the sheets P in the body case while pushing down the intermediate plate 100 in opposition to the springs 101 by hand and without interfering the leading ends of the sheets P with the separating pawls 103, the operability for replenishing the sheets P in the cassette was worsened. To the contrary, the cassette 50 according to the present invention can eliminate this inconvenience, as mentioned above.

Further, the sheet feeder 30 can contain any cassette other than the illustrated sheet supply cassette 50 (having the maximum stacking ability of 500 sheets), such as a cassette having the maximum stacking ability of 200 sheets or less, or a cassette having the maximum stacking ability of 250 sheets, without altering the construction of the feeder. Normally, since there are six kinds of the maximum sheet sizes, i.e., B4 size, A4 size, B5 longitudinal size, B5 lateral size and A5 lateral size, six cassettes having different sizes must be prepared for the normal copying machine and facsimile system. And, regardless of the frequency in use of sheets, such cassettes had the maximum stacking ability of 250 sheets or 200 sheets. However, since a plurality kinds of cassettes having the different maximum stacking abilities can be mounted in the sheet feeder according to the present invention, the sheet supply cassette 50 having the greater sheet stacking ability can be used for the sheets P having the high frequency in use and the sheet supply cassette 50 having the smaller sheet stacking ability can be used for the sheets P having the low frequency in use, thus improving the operability.

Figure 2:
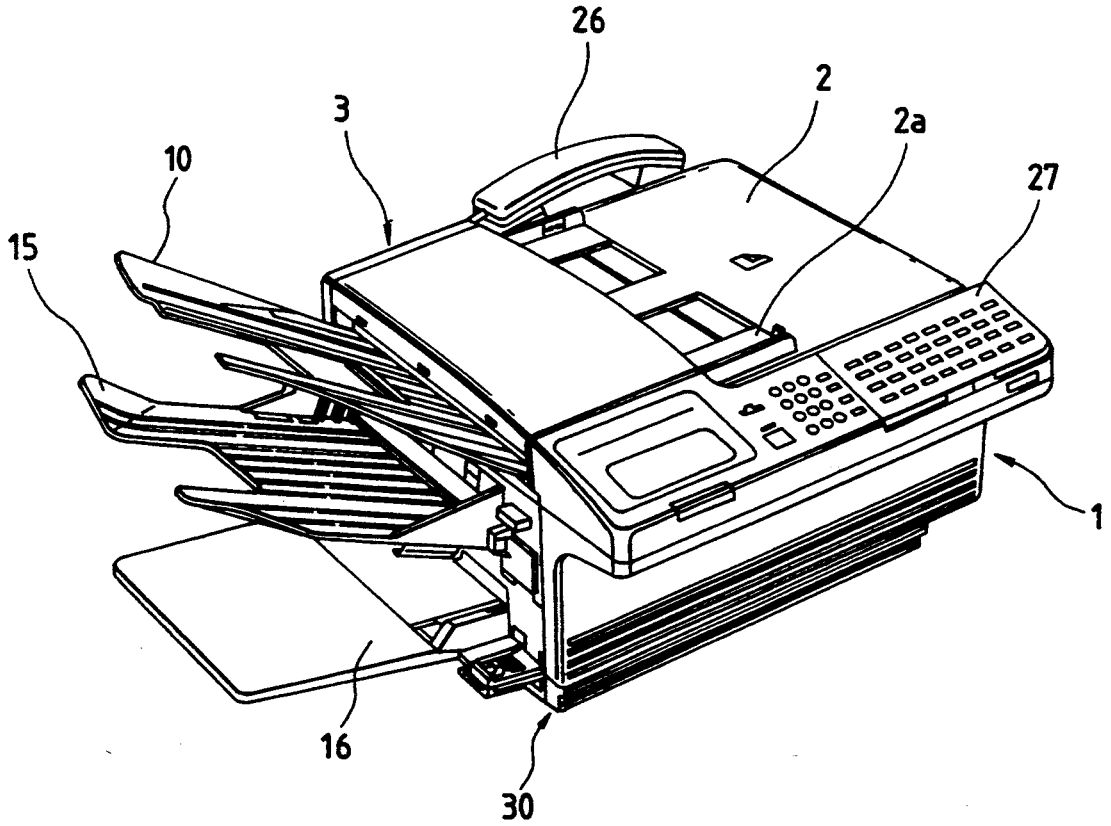
FIG. 2 is a perspective view of the facsimile of FIG. 1.

The sheet supply cassette 50 is mounted within the feeder 30 in such a manner that the cassette 50 with directing its rear wall 51*d* toward the feeder is inserted, from the front side of the feeder 30, into the sheet supply cassette containing space 33 (FIG. 5) defined by the undersurface of the top plate 31 of the feeder 30, upper surface of the installation platform C and inner surfaces of the left and right pedestals 31L, 31R, while guiding the elongated flanger 55L, 55R of the cassette along the longitudinal guide grooves 43 formed in the inner surfaces of the left and right pedestals 31L, 31R of the feeder, respectively (in a direction shown by the arrow X in FIG. 1).

When the cassette 50 is completely inserted, back surfaces of left and right protrusions 52*a* of the gripper 52 at the front side of the cassette are abutted against end surfaces 43*a* (FIGS. 3 and 6) of the guide grooves 43 of the feeder 30, thus preventing further insertion of the cassette and properly positioning the cassette 50 with respect to the feeder 30. Also, when the cassette having the different maximum sheet stacking ability from that of the cassette 50 is mounted within the feeder, the cassette with directing its rear wall toward the feeder is inserted, from the front side of the feeder 30, into the sheet supply cassette containing space 33 (FIG. 5), while guiding the elongated flanger 55L, 55R of the cassette along the longitudinal guide grooves 43 formed in the inner surfaces of the left and right pedestals 31L, 31R of the feeder, respectively (in a direction shown by the arrow X in FIG. 1). In this way, the different cassette can also be properly positioned with respect to the feeder in the same manner as the cassette 50. In such mounted condition, as shown in FIG. 1, the front surface of the cassette 50 is substantially in flush with the left end surface of the facsimile B so that the cassette does not protrude from the left side of the facsimile B, thus avoding the unsightly appearance of the system. Further, even when the cassette having the different maximum stacking ability from the cassette 50 is mounted, any room or clearance is merely generated in the cassette containing space 33, but there is no unsightly appearance of the system.

A maximum distance L1 (FIG. 1) along which the cassette 50 can be inserted with respect to the feeder 30 at the maximum is selected to be greater than a dimension L2 of the feeder 30 in the cassette inserting direction, so that a cassette 50' having a longitudinal dimension greater than the dimension L2 can also be inserted and used. In this case, in a condition that the cassette 50' is properly mounted with respect to the feeder 30, although a rear end portion (leading end regarding the cassette insertion direction) of the cassette 50' is protruded from the rear end of the feeder or the right side of the facsimile B by a distance L4 as shown by a phantom line in FIG. 1, the appearance of the system does not spoiled.

The sheet supply rollers 37 disposed at the top plate 31 of the feeder 30 are semi-cylindrical rollers (D-cut rollers) as mentioned above, and are normally stopped so that the flat cut-outs 37*a* face downwardly, with the result that, when the cassette 50 is inserted into the feeder 30, the top edge of the rear wall 51*d* of the body case 51 of the cassette passes through below the downwardly directed cut-outs 37*a* of the sheet supply rollers 37 without interfering with the latter.

Further, up to immediately before the cassette 50 is completely inserted into the feeder 30 and properly positioned therein, the intermediate plate 56 is not subjected to the urging forces from the pressurizing levers 59 and is laid on the bottom wall 51*e* of the body case 51 of the cassette as shown in FIG. 11, with the result that the sheet stack P rested on the intermediate plate is housed in the body case 51 with balancing with the biasing forces of the compression coil springs 65*a*. Thus, during the insertion of the cassette 50 into the feeder 30, the upper surface of the uppermost sheet on the sheet stack P housed in the body case 51 of the cassette is sufficiently spaced apart from the downwardly directed cut-outs 37*a* of the sheet supply rollers 37, and, therefore, the uppermost sheet on the sheet stack P in the cassette 50 does not interfere with the sheet supply rollers 37 of the feeder 30. That is to say, by making the sheet supply rollers 37 of the feeder 30 as the semi-cylindrical rollers and by positioning the cut-outs 37*a* of the rollers so that they are normally directed downwardly, the height of the sheet supply cassette containing space 33 defined by the undersurface of the top plate 31 of the feeder, upper surface of the installation platform C and inner surfaces of the left and right pedestals 31L, 31R can be increased, and, thus, the sheet stacking ability of the cassette 50 can be increased accordingly.

Immediately before the cassette 50 is completely inserted into the feeder 30 and properly mounted therein, both left and right ends 61L, 61R of the pressurizing shaft 61 protruding from the left and right side walls 51*b*, 51*c* of the cassette 50 are engaged by the cam grooves 45*b* formed in the inner surfaces of the left and right pedestals 31L, 31R. During the further insertion of the cassette 50 into the feeder, the both left and right ends 61L, 61R of the pressurizing shaft 61 are shifted downwardly along the cam grooves 45*b*, with the result that the pressurizing shaft 61 is shifted downwardly from the top ends of the inclined slots 62 to bottom ends thereof along the slots. The downward movement of the pressurizing shaft 61 causes the anti-clockwise rotation of the pressurizing levers 59 around the pins 59*a* via the tension coil springs 63, thus cocking the horizontal arms 59*b* of the levers 59 upwardly, with the result that the intermediate plate 56 on which the sheets P are stacked is rotated around the pins 56*a* via the arms 59*b*, thus lifting the front end of the intermediate plate. When the cassette 50 is completely inserted and mounted in the feeder, the pressurizing shaft 61 reaches the bottom ends of the inclined slots, with the result that the both left and right ends 61L, 61R of the shaft reach lowermost ends 45*d* (FIG. 6) of the cam grooves 45*b* and are held there. Incidentally, in the cassette having the maximum sheet stacking ability of 250 sheets, the shaft 61 is shifted along the cam grooves 45*a* and is held at upper ends 45*c* of such cam grooves.

Figure 12:
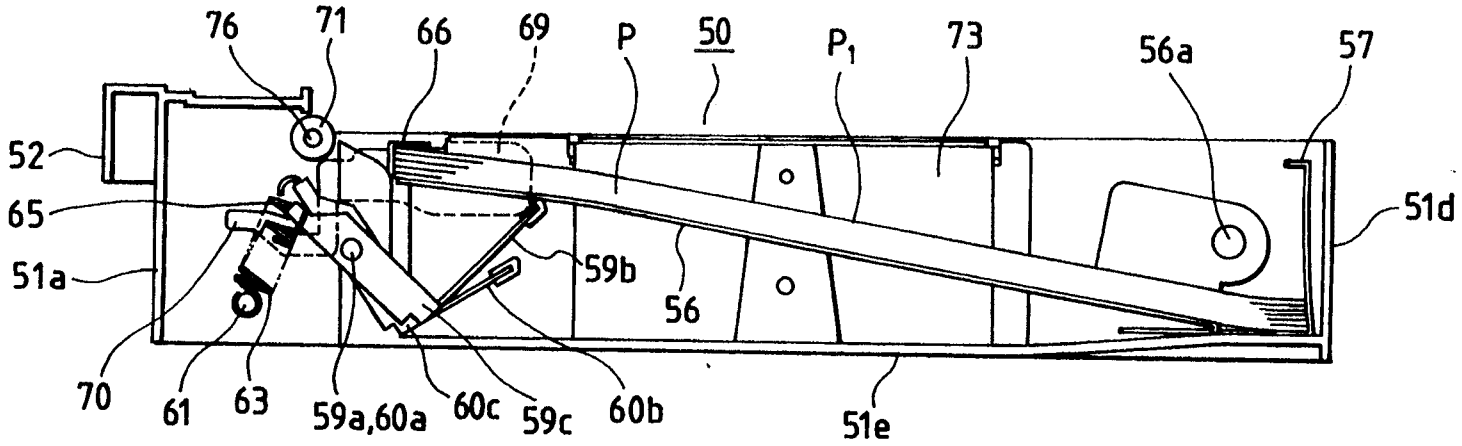
FIG. 12 is an elevational sectional view for explaining an operation of the sheet supply cassette.

On the other hand, during the lowering movement of the pressurizing shaft 61 along the slots 62, the pivot levers 69 having the lever extensions 70 rested on the pressurizing shaft is firstly lowered and rotated around the pins 67 in the clockwise direction. However, when the separating pawls 60 of the pivot levers 69 are engaged by the front corners of the sheet stack P being lifted in response to the lifting movement of the front end of the intermediate plate 56 caused by the lowering movement of the pressurizing shaft 61, the further rotation of the pivot levers are prevented. Then, the lever extensions 70 are separated from the pressurizing shaft 61 during the further lowering movement of the latter. When the lever extensions 70 are separated from the pressurizing shaft 61, the separating pawls 66 are lowered and rested on the front corners of the sheet stack P by their own weights. In this way, the separating pawls are positioned so that they can separate the sheets one by one (see FIG. 12).

Figure 13:
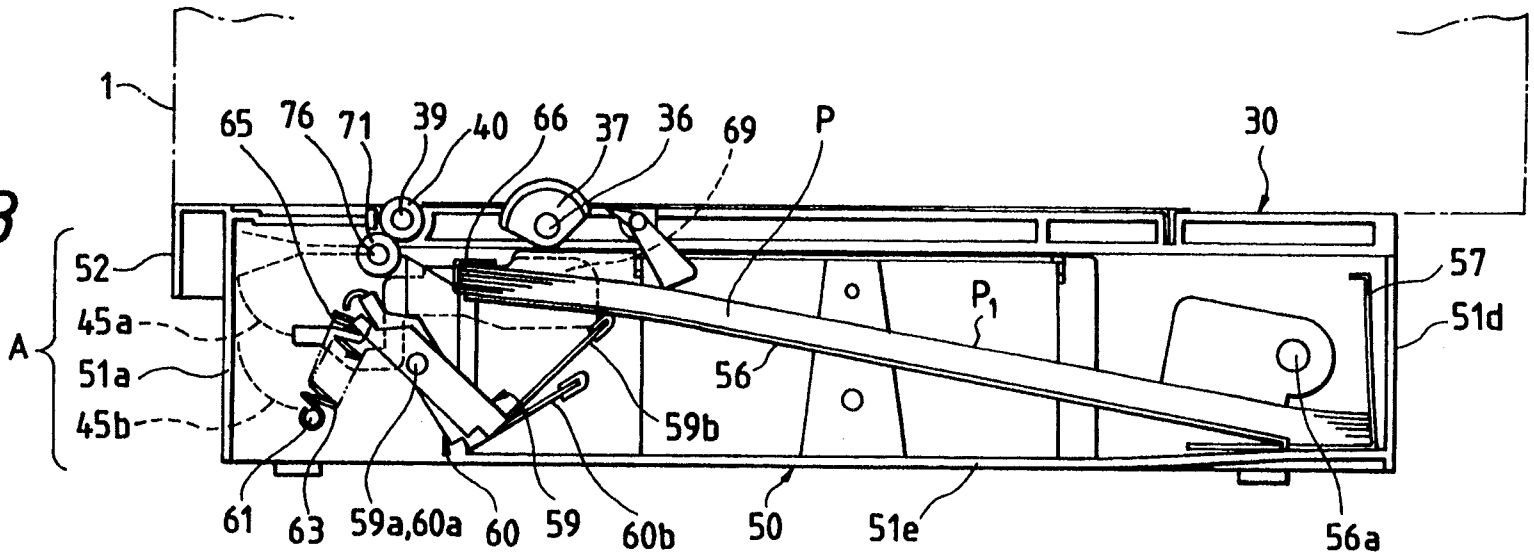
FIG. 13 is an elevational sectional view showing a condition that the sheet supply cassette was mounted on the sheet feeder.

When the cassette 50 is completely mounted within the feeder 30, the sheet feed rollers 71 are engaged by the lower surfaces of the sheet feed rollers 40 of the feeder 30 (see FIGS. 1 and 13).

The sheet supplying apparatus A of FIG. 1 is shown in the condition that various members are positioned as mentioned above after the cassette 50 has completely been inserted into the feeder 30.

In this condition, when an image formation start signal is inputted to the control circuit of the facsimile B by selecting an appropriate mode for using the sheet supplying apparatus A via a console of the facsimile B, the gears G1-1 G3 are rotated. At this point, since the spring clutch 42 and the spring clutch associated with the gear G2 are maintained at the clutch-off conditions, the sheet supply rollers 37 and the sheet feed rollers 40 are kept stationary. Thereafter, when the electromagnetic solenoid plunger 42*a* of the feeder 30 is temporarily energized via the control circuit of the facsimile B in response to a sheet supply start signal, the one-revolution clutch 42 is turned ON, thus rotating the sheet supply rollers by one revolution in the clockwise direction (FIG. 1). Consequently, the cylindrical portions 37*b* of the sheet supply rollers 37 act on the uppermost sheet of the sheet stack P on the intermediate plate 56, thus applying to the uppermost sheet a feeding force directing toward a direction opposite to the cassette inserting direction with respect to the feeder 30, with the result that the uppermost sheet alone is separated from the sheet stack by means of the separating pawls 66 and fed toward the front wall 51*a* of the cassette 50.

The leading end of the fed sheet P is guided by the forwardly and downwardly inclined guide plate 53 and is directed to nips between the sheet feed rollers 40, 71 from the lower side, and then is pinched by the nips and is temporarily stopped there. Thereafter, when the electromagnetic solenoid plunger 42*c* is turned ON, the sheet is fed upwardly to reach the interior of the facsimile B through a sheet receiving opening 75 formed in the bottom of the facsimile B. The sheet P fed into the facsimile B is fed to and pinched by nips between the feed rollers 13*a* and the convey rollers 13*c* via a guide plate 75*a*, and then is fed to the transfer portion 12*f*. The image forming operation in the facsimile B is the same as that already described regarding the sheet supplied from the multi-feed tray 16.

In this way, every time the sheet supply rollers 37 of the feeder 30 are rotated by one revolution, the sheets P stacked in the cassette 50 mounted within the feeder 30 are supplied toward the facsimile B one by one, and the images are sequentially formed on the fed sheets, respectively.

Figure 30:
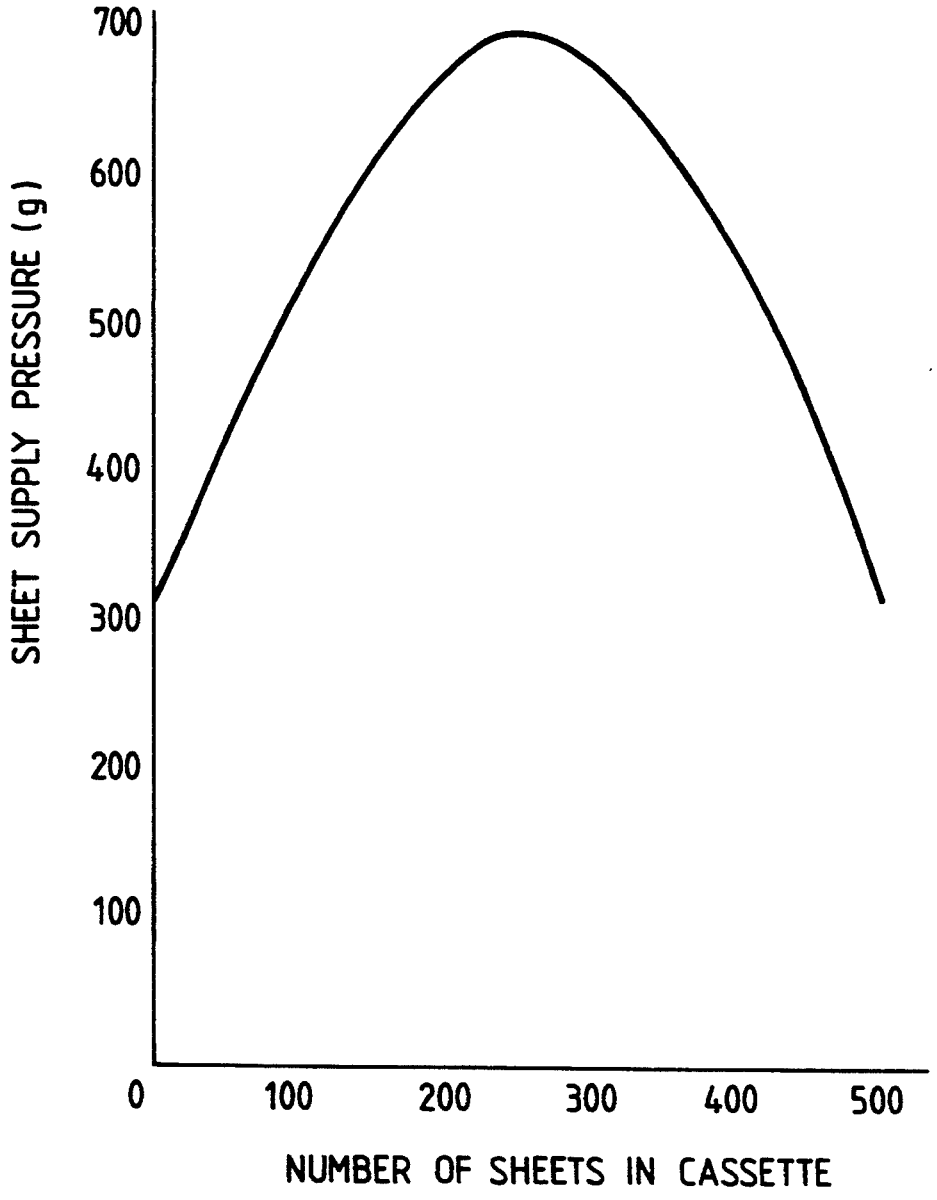
FIG. 30 PRIOR ART
FIG. 30 is a graph showing a relationship between a sheet stacking amount and a sheet supply pressure when a conventional structure is applied to a cassette having the greater sheet stacking ability.

As the amount of the sheets stacked in the cassette 50 is decreased, the intermediate plate 56 are gradually rotated upwardly since the pressurizing levers 59 are gradually rotated in the anti-clockwise direction by the charging forces of the tension coil springs 63. In this respect, with respect to the conventional sheet supply cassette having the maximum sheet stacking ability of 250 sheets, as the intermediate plate 56 was being rotated upwardly around the pins 56*a* due to the anti-clockwise rotation of the pressurizing levers 59 around the pins 59*a*, the sheet supply pressure was in the order of 300–400 grams through the first to 250th sheets. However, regarding the cassette having the maximum sheet stacking ability of 500 sheets, when the sheet supply pressure was measured, the result as shown in FIG. 30 was obtained. That is to say, the sheet supply pressure regarding the first sheet was 300 grams, 250th sheet 730 grams and 500th sheet 300 grams, which resulted in the non-uniform distribution of the sheet supply pressure not to provide the stable sheet supply pressure. Thus, when the thicker sheets or thin sheets were used, undesirable phenomena such as the poor sheet supply, skew-feed, double-feed and the like occurred.

Figure 14:
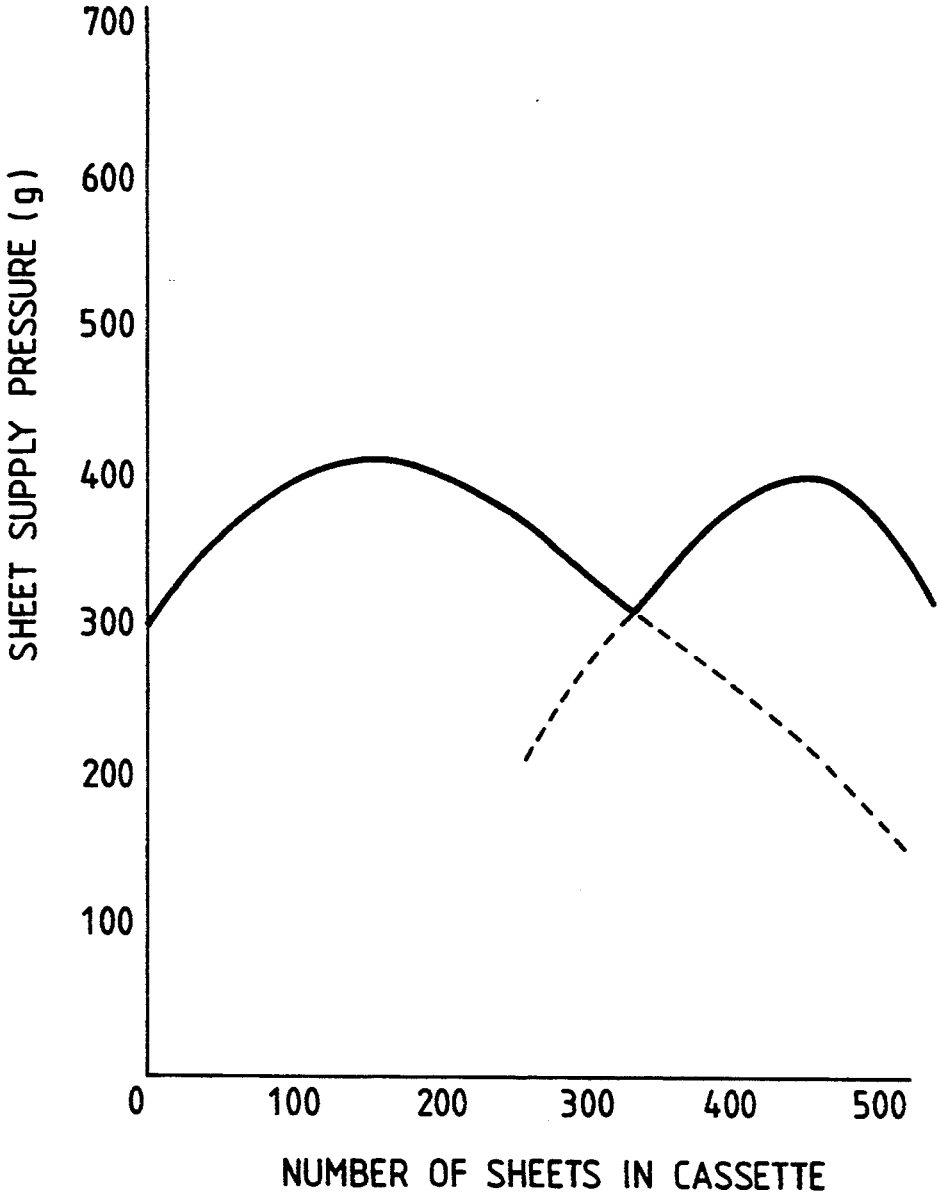
FIG. 14 is a graph showing a relationship between a sheet stacking amount and a sheet supply pressure.

Thus, to provide a stable sheet supply pressure, according to the present invention, regarding the pressurizing levers 59, 60, two pressurizing levers 59 are arranged at both ends of the body cassette 51, and a single pressurizing lever 60 is arranged at a central portion within the body case (see FIG. 7 and 11). The pressurizing levers 59 arranged at the both ends of the body case 51 are set in the same manner as the conventional cassette having the maximum sheet stacking ability of 250 sheets, so that they can pressurize the first to 300th sheets (regarding the 301th to 500th sheets, these levers can apply any pressure which is smaller than the sheet supply pressure of 300 grams); and the newly provided central pressurizing lever 60 compensates the reduced sheet supply pressure lower than 300 grams due to the side pressurizing levers 59 acting on 301th to 500th sheets. As a result, the distribution of the sheet supply pressure becomes as shown in FIG. 14, which can maintain the sheet supply pressure to a constant level of 300–500 grams although it has two peaks.

Figure 21A:
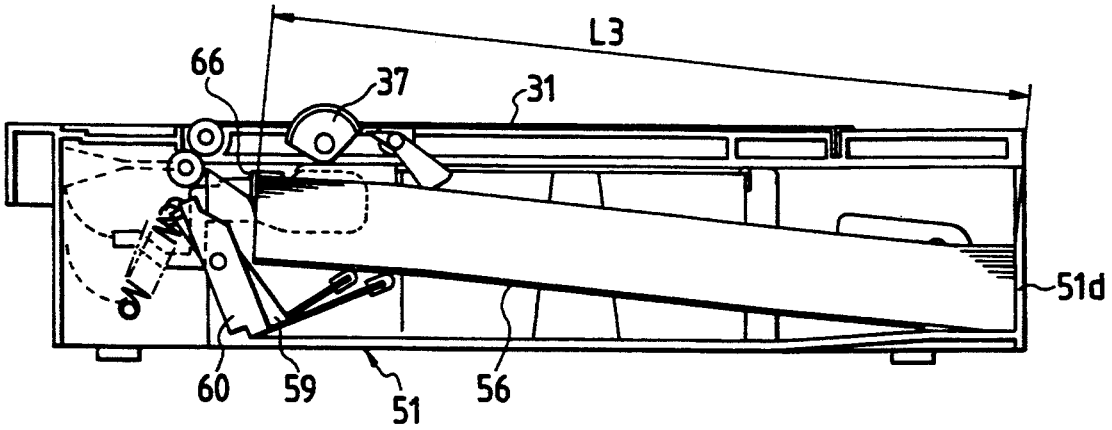
FIGS. 21A, 21B, and 21C are views showing the change in a distance or length L3 (between separating pawls and a trailing end of a sheet)
Figure 21B:
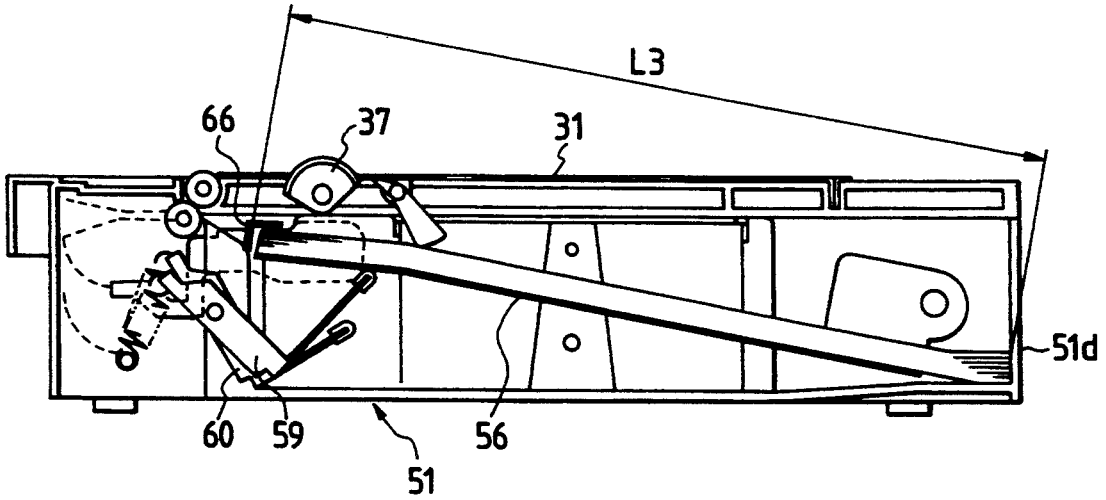

Further, as the amount of the sheets P stacked in the cassette 50 is decreased, when the intermediate plate 56 are gradually rotated upwardly since the pressurizing levers 59 are gradually rotated in the anti-clockwise direction by the charging forces of the tension coil springs 63, 65, a distance or length L3 shown in FIG. 21A decreases (the lesser the sheet amount, the longer the distance L3 (FIG. 21B)). If a sheet stacking plate can be shifted horizontally such as a paper deck having the greater sheet stacking ability, the distance L3 does not change regardless of the sheet amount. However, regarding the sheet supply cassette, since the thickness of the cassette is reduced as thinner as possible in consideration of the insertion and/or retraction of the cassette and thus it is impossible to arrange a mechanism for shifting the sheet stacking plate horizontally in a space within the cassette, a plate called as an "Intermediate plate" and pivoted around its rear end in an up-and-down direction is normally used.

Figure 22:
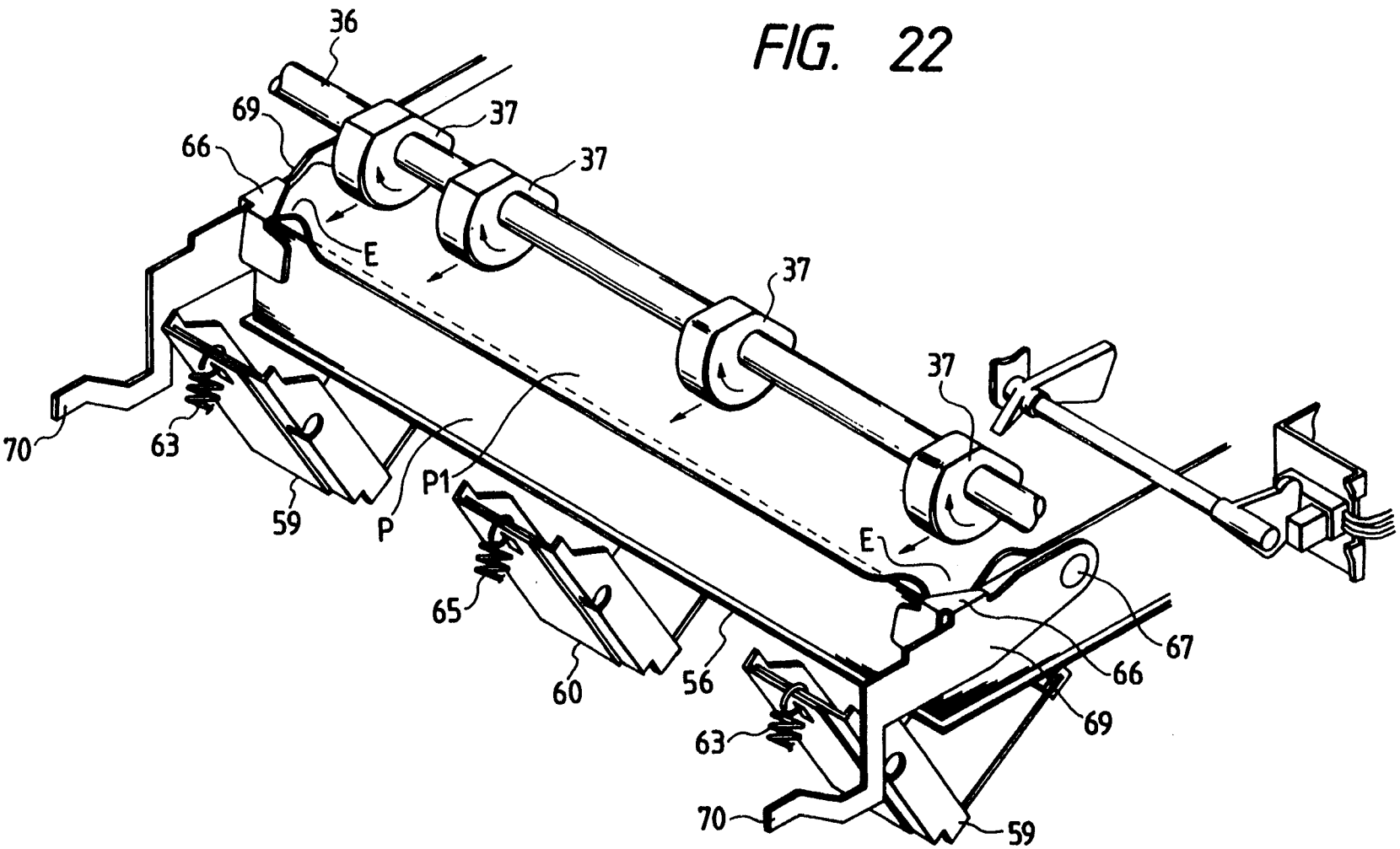
FIG. 22 is a perspective view for explaining a condition that the sheets are separated one by one.
Figure 23:
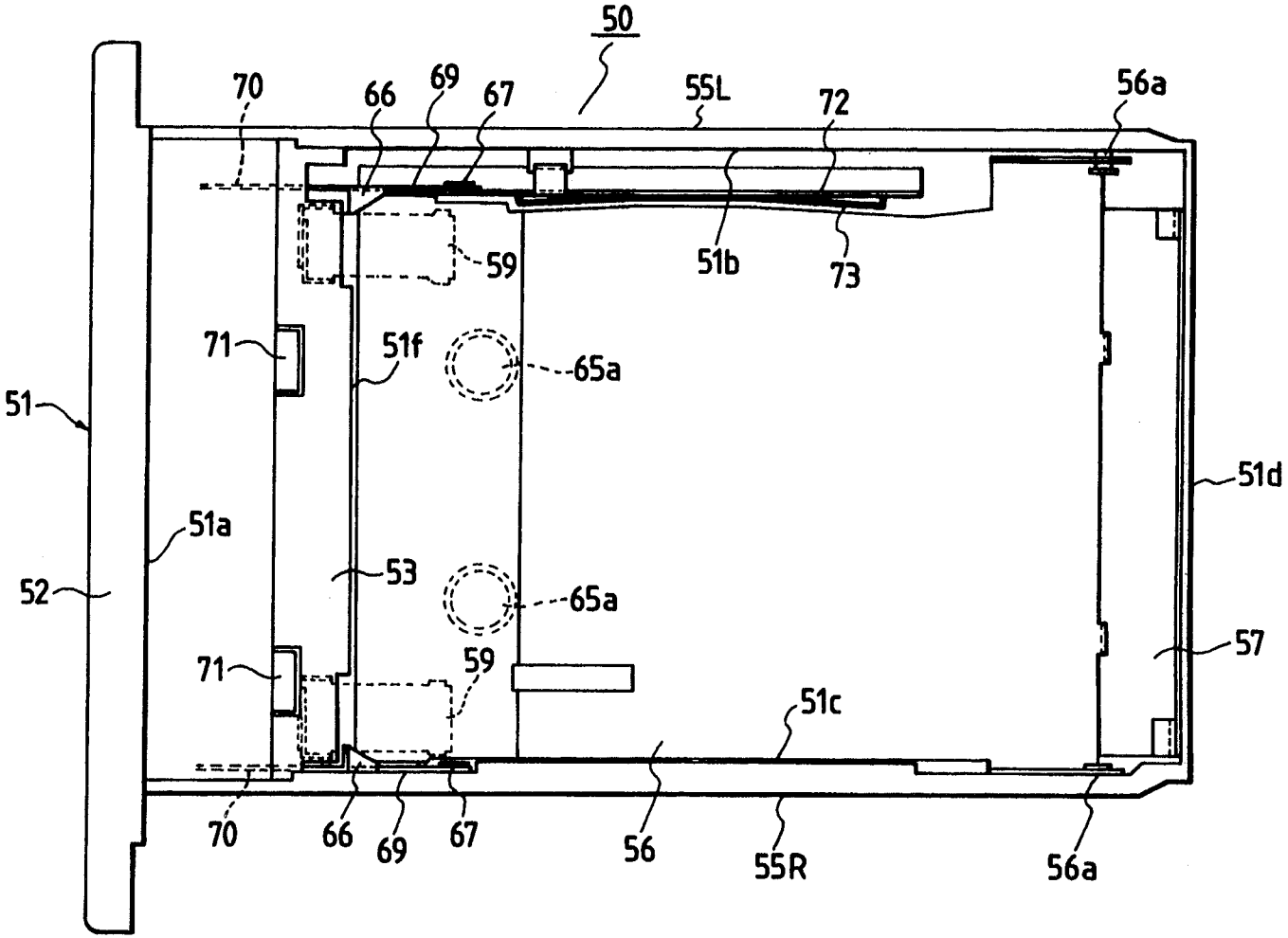
FIG. 23 is a plan view of a sheet supply cassette according to a second embodiment of the present invention.

Regarding the conventional cassette having the maximum sheet stacking ability of 250 sheets or less, the amount of change in the distance L3 does not affect the bad influence upon the sheet supplying ability. However, regarding the cassette having the maximum sheet stacking ability of 500 sheets, since the rotational angle of the cassette becomes, by twice, greater than that of the cassette having the maximum sheet stacking ability of 250 sheets, the change in the distance L3 directly affects the bad influence upon the sheet supplying ability. That is to say, when the amount of the sheet stack is decreased, the sheets are slid down (along the greater inclined intermediate plate), which reduces the engagement amount between the paired left and right separating pawls 66 and the left and right front corners of the uppermost sheet of the remaining sheet stack. Consequently, since the holding forces of the separating pawls 66 against the uppermost sheet becomes insufficient, the adequate bent loop E (FIG. 22) cannot be formed in the uppermost sheet near the separating pawls 66 in opposition to the resiliency of the sheet as the sheet supply rollers 37 are rotated, thus causing the poor separation.

Figure 15:
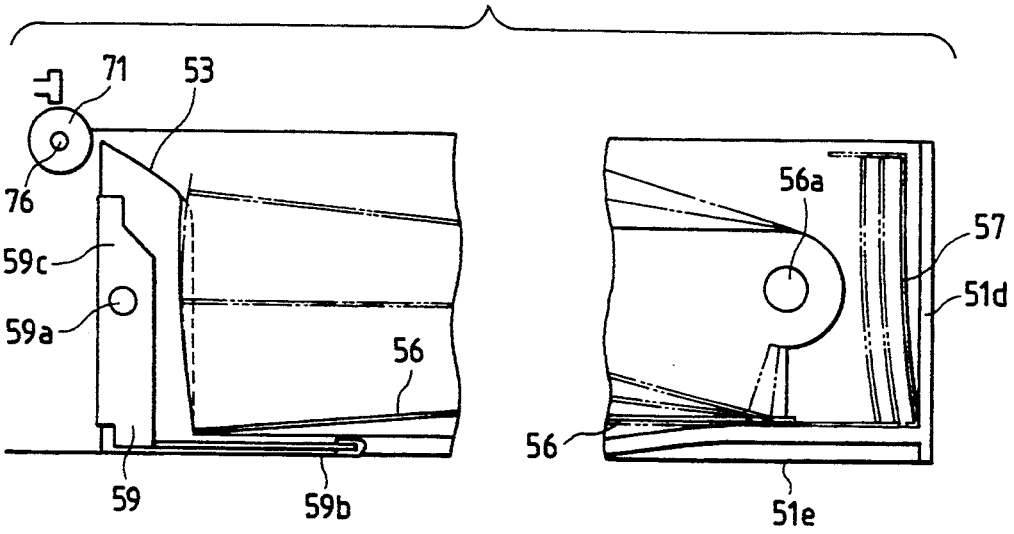
FIG. 15 is a view showing a movement of a trailing end regulating plate.
Figure 16:
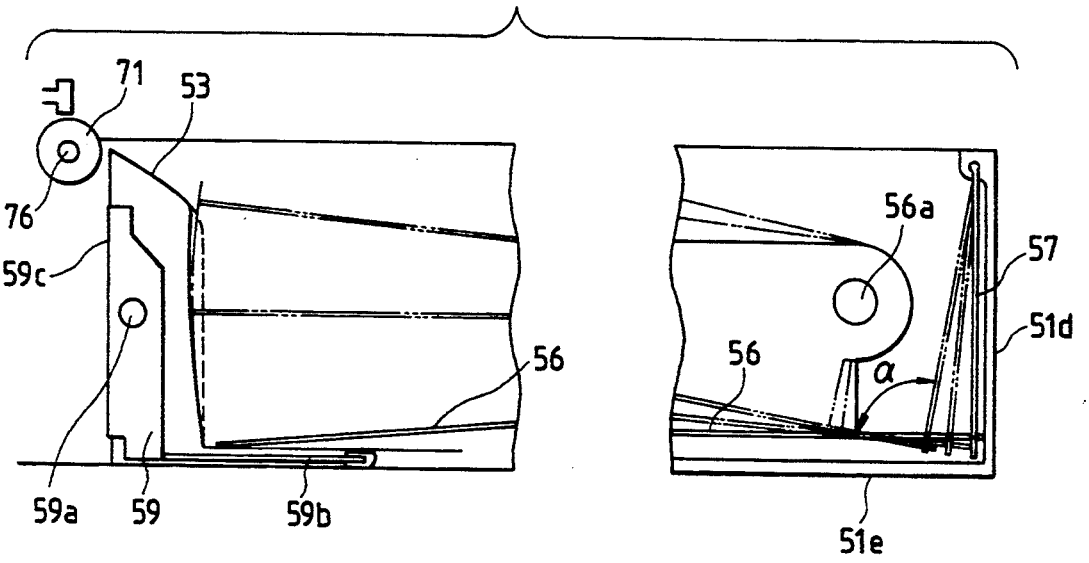
FIG. 16 is a view showing a movement of a trailing end regulating plate 56.

To avoid this, according to the present invention, the trailing end (of the sheet stack) regulating plate 57 connected to the intermediate plate 56 can be shifted horizontally in response to the pivotal movement of the intermediate plate 56 as shown in FIG. 15 and the trailing end regulating plate 57 is so shaped as to coincide with an arc locus of the leading end of the intermediate plate 56 being pivoted. In this way, it is possible to keep the distance L3 constant regardless of the stacked sheet amount, and, therefore, to always keep the holding forces of the separating pawls against the uppermost sheet constant. Alternatively, in order to keep the distance L3 constant, as shown in FIG. 16, the trailing end regulating plate 57 may be pivotally mounted at its upper end on the upper portion of the rear wall of the body case 51 of the cassette and a free end of the trailing end regulating plate 57 may be connected to the rear end of the intermediate plate 56. In this case, when the intermediate plate 56 is rotated around the pins 56*a*, the trailing end regulating plate 57 connected to the intermediate plate 56 is also rotated around its upper end pivotally mounted on the rear wall of the body case 51 of the cassette, thus always keeping an angle between the intermediate plate 56 and the trailing end regulating plate 57 constant (90°±10°) regardless of the stacked sheet amount. In this way, it is possible to keep the holding forces of the separating pawls against the uppermost sheet constant.

A further method for keeping the distance L3 constant will be explained. As shown in FIG. 22C, an inclination angle of the intermediate plate 56 with respect to the horizontal plane is changed in accordance with the stacked sheet amount. That is to say, the inclination angle of the intermediate plate when 500 sheets are rested on the intermediate plate (position shown by a) is smaller than that of the intermediate plate when only one sheet is rested on the intermediate plate (position shown by b).

Thus, by arranging the pivot centers (pins 67) P for the separating pawls 66 so that the separating pawls 66 are pivotally rotated rearwardly (toward the rear end of the intermediate plate 56) in accordance with the lifting movement of the separating pawls 66, the distance L3 can be kept substantially constant. That is to say, the pivot centers P are set so that, as illustrated, when a large number of sheets are stacked on the intermediate plate, the separating pawls 66 are held at a position shown by A, and, as the stacked sheets are decreased, the separating pawls 66 are pivotally rotated toward a position shown by B.

In this way, it is possible to keep the distance L3 substantially constant regardless of the stacked sheet amount, and, thus, to always keep the holding forces of the separating pawls 66 against the sheets constant.

Further, as shown in FIG. 11, the leading end portion of the intermediate plate 56 is bent downwardly by an angle $\theta$ of 5–7° so that the sheet can always be fed to the guide plate 53 of the body case 51 at a constant position when the first to 500th sheets are supplied. If the sheet supplying position is not constant through the first to 500th sheets, the sheet can not always be guided to the nip between sheet rollers (convey rollers) 71 and the sheet feed rollers (driving rollers) 40 of the feeder 30 correctly, thus causing the poor sheet supply.

Figure 17A:
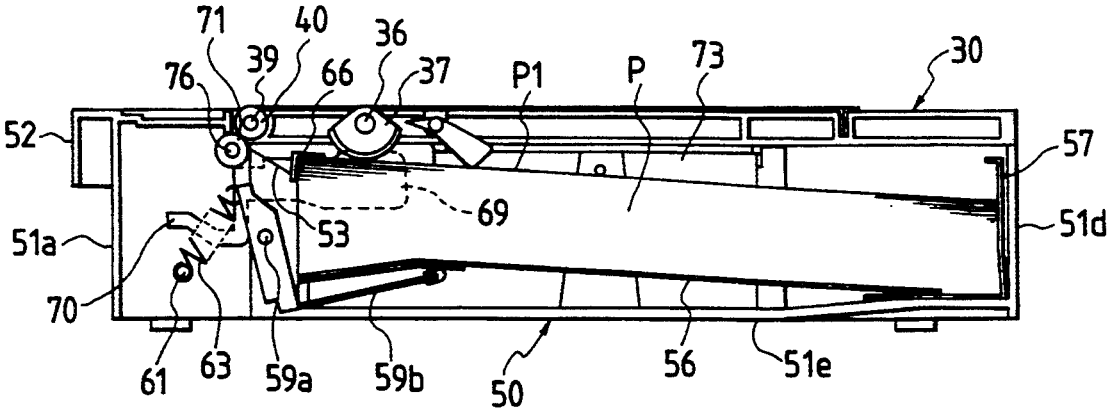
FIGS. 17A and 17B are elevational sectional views showing the change in an inclination angle of a leading end of an intermediate plate.
Figure 17B:
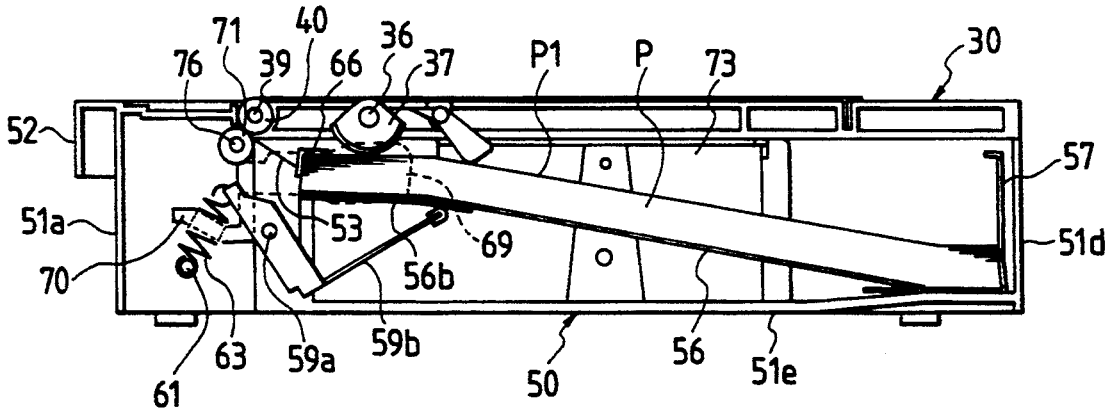
Figure 18A:
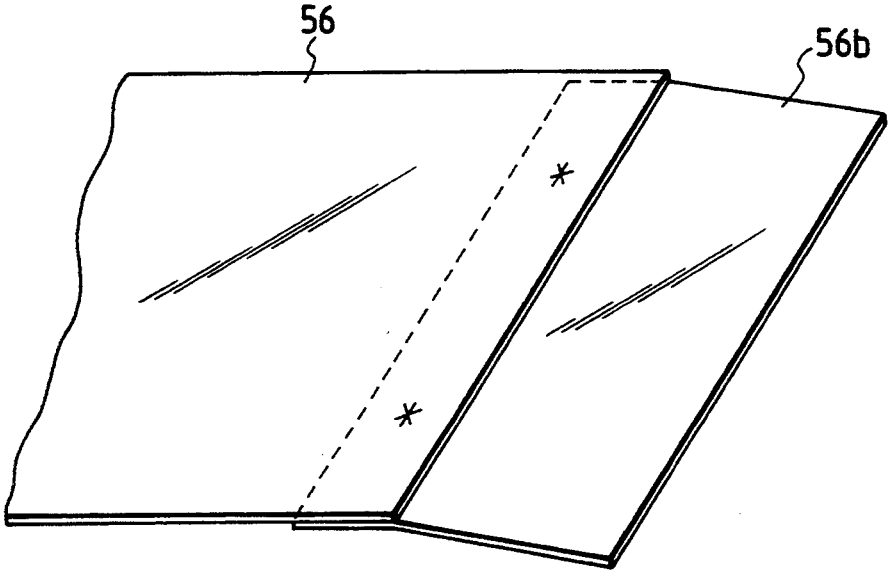
FIGS. 18A and 18B are perspective views showing a leading end of the intermediate plate an inclination angle of which is variable.
Figure 18B:
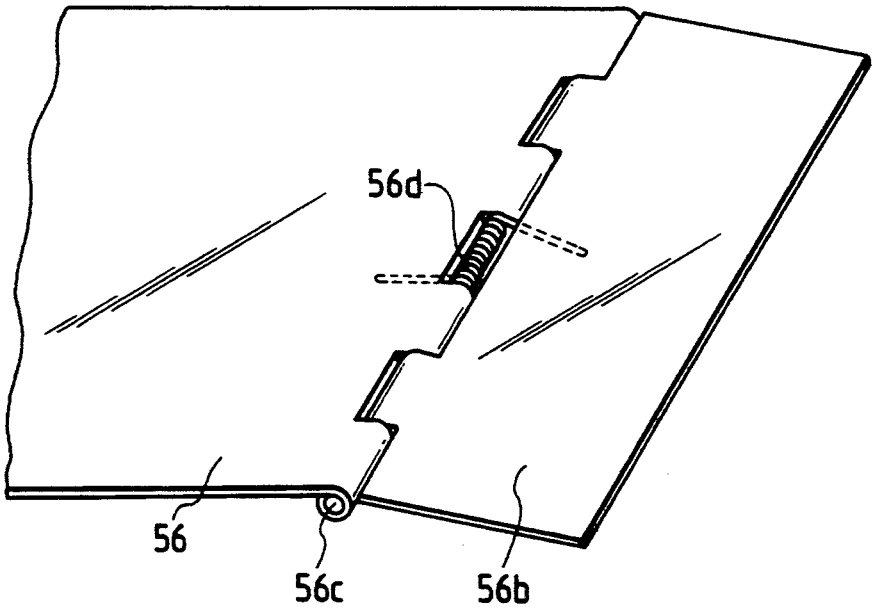

As shown in FIGS. 17A and 17B, by changing the inclination angle of the leading end portion of the intermediate plate 56, it is possible to always keep the sheet supplying position constant with respect to the guide plate 53 during the sheet supplying operation. To this end, as shown in FIG. 18A, the intermediate plate 56 is divided into two so that a main portion of the intermediate plate 56 is made of cold-rolled stainless steel plate (SPCC-SD) having a thickness of 0.8–1.2 mm as in the conventional case and a free end plate portion 56*b* of the intermediated plate is made of spring stainless steel strip (SUS27CS1, SUS27CS3 or the like). Alternatively, as shown in FIG. 18B, the free end plate portion 56*b* of the intermediate plate may be made of cold-rolled stainless steel plate (SPCC-SD) having a thickness of 0.8–1.2 mm as same as that of the main portion of the intermediate plate 56, and the free end plate portion may be hinged to the main portion via a shaft and may be biased upwardly by a spring member 56*d* so that it can be returned to its original state (a state that there is no sheet thereon). Alternatively, although not shown, the whole intermediate plate may be molded from resin so that a thickness of an intermediate portion between the main portion of the intermediate plate 56 and the free end plate portion 56*b* is thinner than the remaining portion thereby to utilize the intermediate portion as a returning spring due to its elasticity. According to the test result, it was found that, when the 100 sheets were rested on the intermediate plate in the body case 51 of the sheet supply cassette, the free end plate portion 56*b* was subjected to a load of about 100 grams, and 200 sheets, 300 sheets, 400 sheets and 500 sheets generated the loads of about 200 grams, 300 grams, 400 grams and 500 grams, respectively. In consideration of these values, by properly selecting a thickness of the spring strip, a biasing force of the spring member or a thickness of the intermediate hinge portion, it is possible to always keep the sheet supplying position constant with respect to the guide plate 53 regardless of the amount of the sheets stacked in the cassette 50.

Further, unlike to the conventional cassette having the maximum sheet stacking ability of 250 sheets, the sheet abutting wall 51*f* is formed to coincide with the arc locus of the leading end of the intermediate plate 56 (see FIGS. 15 and 16). In the conventional cassette having the maximum sheet stacking ability, a height of the sheet stack is 25 mm (regarding regular sheet having a weight of 64 g/m$^2$), and the pins 56*a* around which the rear end of the intermediate plate is pivoted are normally an half of the maximum sheet stacking height, i.e., 25/2 mm, to minimize the change in the distance L3 already described regarding the trailing end regulating plate 57 regardless of the stacked sheet amount. With this arrangement, the rotational angle of the intermediate plate 56 and the sheet abutting wall 51*f* of the body case 51 of the sheet supply cassette do not affect the bad influence upon the sheet supply. However, if the cassette having the maximum sheet stacking ability of 500 sheets is designed with the above-mentioned criterion, the height of the sheet stack (regarding the regular sheet having a weight of 64 g/m$^2$) will be 50 mm, and the rotational angle of the intermediate plate 56 will be a twice of that of the cassette having the maximum sheet stacking ability of 250 sheets. When the sheet containing space within the body case 51 of the sheet supply cassette is determined, since the tolerance of the sheet is ±1 mm in accordance with the Japanese Industrial Standard, for example, in order to design a cassette of A4 type with a nominal dimension of 298 mm (297 mm+1 mm), if the change in the distance L3 is minimized, the sheet stack including about 250 sheets interferes with the sheet abutting wall 51*f* of the body case 51 of the sheet supply cassette. As a result, the pressurizing levers 59 are rotated around the pins 59*a* in the anti-clockwise direction and thus are interfered with the intermediate plate 56 being rotated upwardly around the pins 56*a*, with the result that the proper sheet supply pressure cannot be obtained (the intermediate plate 56 cannot be lifted up to the proper position), thus causing the poor sheet supply.

To avoid this, according to the present invention, by coinciding the shape of the sheet abutting wall 51*f* of the body case 51 of the sheet supply cassette with the arc locus of the leading end of the intermediate plate 56, it is possible to prevent the interference between the sheet and the sheet abutting wall 51*f* of the body case 51 of the cassette during the pivotal movement of the intermediate plate 56, to minimize the change in the distance L3 and to provide the proper sheet supply pressure. In this way, a height level of the leading end of the uppermost sheet of the sheet stack on the intermediate plate 56 can always be kept constant.

Further, to minimize the influence upon the sheet supply pressure, in the copying machine, the sheet supply rollers 37 are formed as the semi-cylindrical rollers (D-cut rollers) and are positioned so that they are-normally stopped with their cut-outs 37*a* directing downwardly (see FIGS. 1 and 6). In this condition, the intermediate plate 56 is positioned above the sheet supplying position, and is lowered to the proper position when the uppermost sheet is separated and supplied due to the rotation of the sheet supply rollers 37. During the sheet supplying operation, since the upward and downward pivotal movements of the intermediate plate 56 are repeated, the sheet is contacted with the sheet abutting wall 51*f* of cassette 50 delicately. Further, since it is difficult for the operator to load 500 sheets in the body case 51 of the sheet supply cassette at a time and, thus, the sheets are loaded in lots (200 sheets, 250 sheets or the like), the leading ends of the sheets are dispersed more or less immediately after they are stacked as a sheet stack. Further, according to the Japanese Industrial Standard, since there is the tolerance (dispersion) of ±1 mm in sheets, the leading ends of the stacked sheets are also dispersed delicately. Regarding the cassette having the maximum sheet stacking ability of 500 sheets, since the sheet pressurizing mechanism must be arranged at the least space and the more precise pressurizing force than that of the cassette having the maximum sheet stacking ability of 250 sheets are required, it is preferable that the sliding resistance against the pressurizing force is reduced as small as possible.

According to the present invention, even when the leading ends of the stacked sheets are dispersed delicately and are interfered with the sheet abutting wall 51*f* of the body case 51 of the cassette, in order to avoid the influence upon the sheet supply pressure, after the body case 51 of the cassette is molded from the resin, the sheet abutting wall 51*f* is mirror-finished (by polishing it by a paper file of #2000). Alternatively, the sheet abutting wall 51*f* may be coated by low friction resin material such as 4-fluoride resin or a sheet made of such low friction resin material may be adhered to the sheet abutting wall. Alternatively, by molding the body case 51 of the cassette itself with 4-fluoride resin material, the sliding resistance between the sheets and the sheet abutting wall 51*f* may be minimized. Further, since the similar problem as the sheet abutting wall 51*f* occurs regarding the right side wall 51*c* of the body case 51 of the cassette (because the right side wall 51*c* serves as the reference surface during the sheet supplying operation, which is contacted with the sheets), after the body case 51 of the cassette is molded from the resin, the right side wall 51*c* is mirror-finished (by polishing it by a paper file of #2000). Alternatively, the right side wall 51*c* may be coated by low friction resin material such as 4-fluoride resin or a sheet made of such low friction resin material may be adhered to the right side wall. Alternatively, by molding the body case 51 of the cassette itself with 4-fluoride resin material, the sliding resistance between the sheets and the right side wall 51*c* may be minimized, thus avoiding the influence upon the sheet supply pressure.

Figure 19:
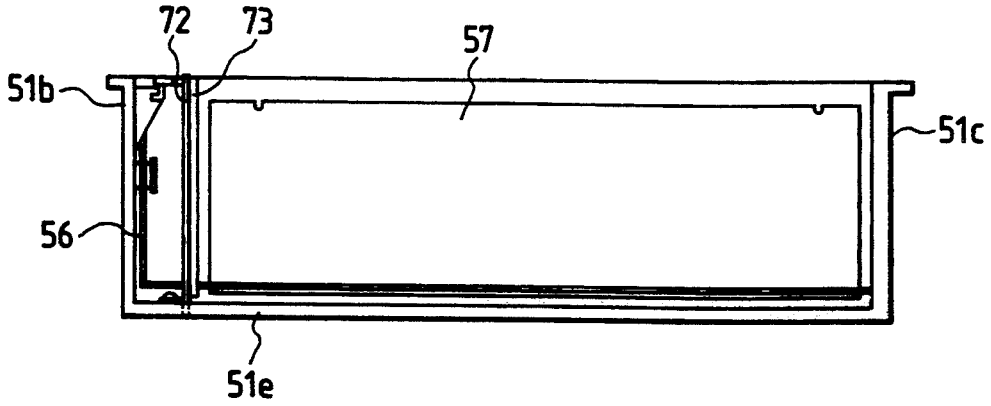
FIG. 19 is a cross-sectional view of a sheet supply cassette showing how to attach a side regulating plate.
Figure 20:
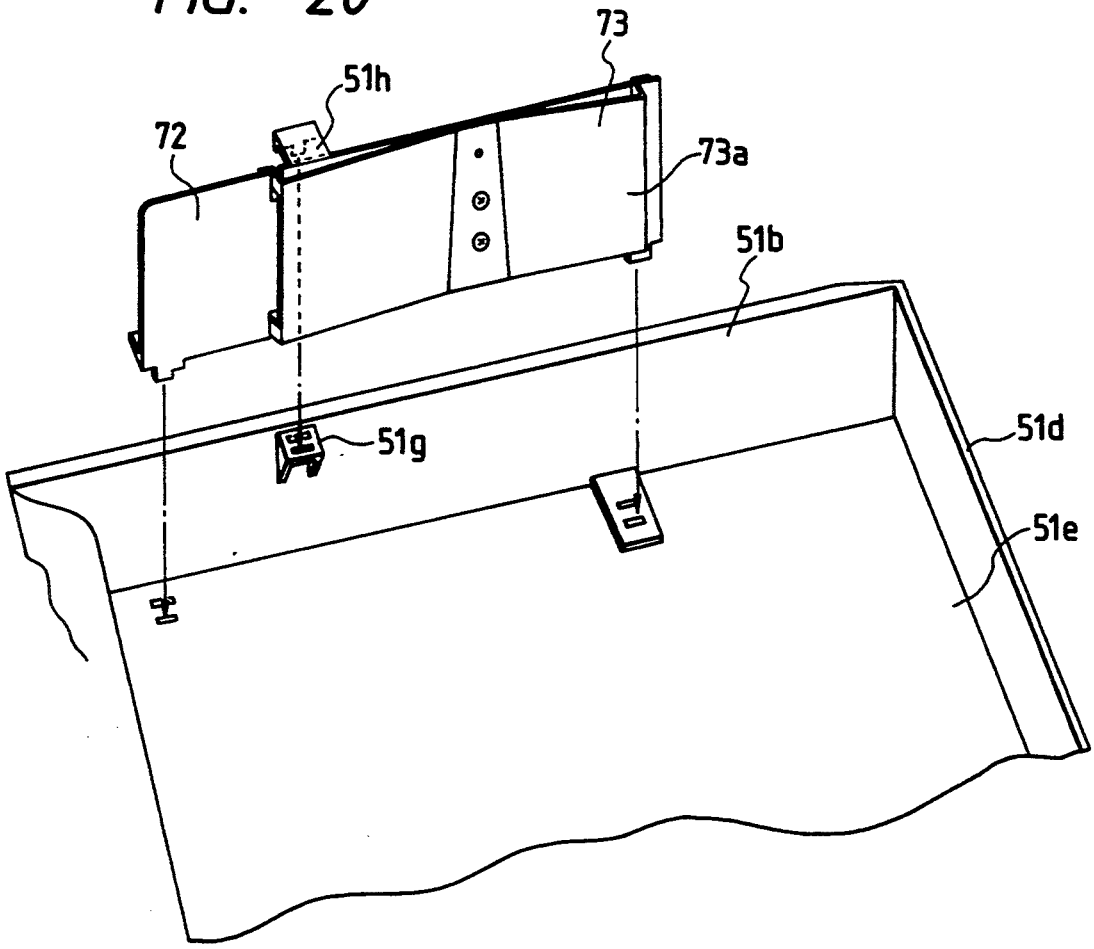
FIG. 20 is a perspective view of the sheet supply cassette showing how to attach the side regulating plate.

FIGS. 19 and 20 show a side regulating plate 72 disposed inside of the left side wall 51*b* of the body case 51 of the sheet supply cassette and adapted to regulate one lateral edge of the sheet stack. The side regulating plate 72 of the conventional cassette having the maximum sheet stacking ability of 200 sheets had a fence height of about 30–35 mm to regulate the sheet stack, and, thus, there was substantially no influence upon the sheet supplying ability even when the side regulating plate was secured to the bottom wall 51*e* of the cassette as it was. However, regarding the cassette having the maximum sheet stacking ability of 500 sheets, since the height of the side regulating plate 72 for regulating the sheet stack becomes 65–70 mm, when the side regulating plate is secured to the bottom wall of the cassette in the conventional manner, it is impossible to precisely position an upper edge and a lower edge of the side regulating plate in the same vertical plane (the upper edge is offset from the lower edge inwardly or outwardly). Further, during the sheet supplying operation, since the sheet is supplied from the uppermost sheet of the sheet stack regardless of the stacked sheet amount, according to the conventional securing method, the sheet is supplied from a portion having the worst dimensional accuracy (upper edge of the side regulating plate 72), thus affecting the bad influence (skew-feed and the like) upon the sheet supplying ability.

Figure 21C:
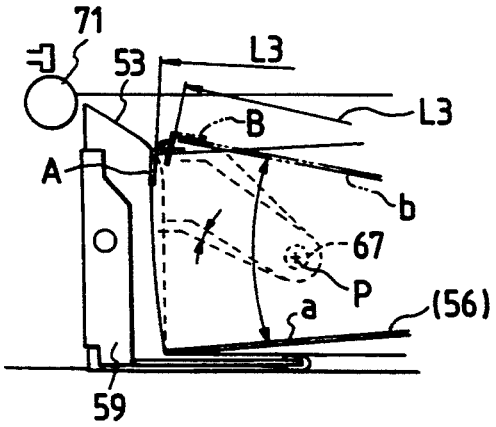

To avoid this, according to the present invention, not relying upon the dimensional accuracy, the side regulating plate 72 is secured so that, as shown in FIGS. 20 and 21, the lower edge portion of the side regulating plate is inserted into the recesses of the bottom wall 51*e* of the cassette and is secured therein by means of lock screws and the upper edge portion of the side regulating plate is secured to the left side wall 51*b* of the cassette by inserting a locking hook 15*h* into the insertion portion 51*g* of the left side wall. In this way, the upper and lower edges of the side regulating plate 72 are stably and accurately positioned in place.

Further, the biasing spring 73 attached to the side regulating plate 72 and adapted to apply the urging force to the lateral side of the sheet stack properly is not influenced upon the attachment accuracy of the side regulating plate 72, thus providing the rated urging force of 110±30 grams, with the result that the skew-feed of the sheet, and the folding and/or damage of the sheets (due to the excessive urging force acting on the lateral side of the sheet stack) can be prevented, thereby improving the sheet supplying ability. Further, by coating the low friction resin material such as 4-fluoride resin on the abutment surface of the biasing spring 73 or by adhering a sheet made of such low friction resin material to the abutment surface of the biasing spring or by making the biasing spring itself from 4-fluoride resin, the sliding resistance between the sheets and the biasing spring may be minimized.

Further, the pair of left and right separating pawls 66 adapted to separate the sheet one by one and engaged by the front (in the sheet supplying direction) corners of the sheet stack in the body case 51 of the sheet supply cassette are formed on the top ends of the pivot levers 69 mounted for pivotal movement in the up-and-down direction around the corresponding pins 67 formed on the left and right front inner end portions of the body case 51. The pair of left and right separating pawls 66 are rested, by their own weights, on the left and right front corners of the uppermost sheet of the sheet stack rested on the intermediate plate 56 in the body case 51 of the cassette, respectively, for the purpose of preventing the advancing movement of the uppermost sheet P1 of the sheet stack P as the uppermost sheet tries to advance in response to the rotation of the sheet supply rollers 37, by holding the front corners of the uppermost sheet by means of the separating pawls. As a result, as the sheet supply rollers 37 are rotated, the bent loop E is formed in the uppermost sheet P1 near the separating pawls 66 between the sheet supply rollers 37 and the separating pawls 66 in opposition to the resiliency of the sheet (see FIG. 22).

When the bent loop E grows up to a certain extent, by a restoring force tending to return the bent loop to the original state, the left and right front corners (retained by the separating pawls 66) of the uppermost sheet P1 naturally shift from lower surface sides to upper surface sides of the separating pawls 66, thus riding over the separating pawls 66 to be separated from the other sheets. However, recently, the problem regarding the environment destruction has been noticed, and, therefore, sheets such as recycle paper made from old paper (old news papers, old copy papers or the like) or made by mixing slick paper of 50–70% with the old paper has been used in the offices in place of the conventional slick paper (having a weight of 60–90 g/m$^2$). Such recycle paper has the property that there is less resiliency although thicker or much resiliency although thinner (in comparison with the conventional slick paper) or it has rough surface. Accordingly, such recycle paper has less reliability (than the conventional paper) due to the greater coefficient of friction between two sheets of paper and the like, which results in the greater possibility of the poor paper supply, double-feed and the like. Thus, according to the present invention, the separating pawls 66 rested, by their own weights, on the sheet stack on the intermediate plate 56 in the body case 51 of the cassette are so set as to provide a load of 20 g±6 g (If the load is greater than the above value, in case of thinner sheets or less resilient sheets, they are difficult to ride over the separating pawls, thus causing the poor sheet supply. To the contrary, if the load is smaller than the above value, in case of thicker sheets or greater resilient sheets, they will ride over the separating pawls 66 too fast, thus causing the poor sheet supply timing, double-feed and the like). Incidentally, when the load is set within the above range, even the recycle sheets can be supplied without no trouble. Further, to further stabilize the sheet supplying ability, abutment surfaces (against the sheet) of the separating pawls 66 may be coated by low friction resin material such as 4-fluoride resin to facilitate the riding of the sheet over the separating pawls.

By setting the load of the separating pawls to the above value range, even when the thicker sheets, thinner sheets, recycle sheets and the like are used, it is possible to prevent the poor sheet supply, double-feed or the like, and, therefore, to always maintain the stable sheet supplying ability without limiting or restricting the kinds of available sheets or the available conditions of the system. Further, the cassette 50 can be dismounted or retracted from the feeder 30 by pulling the gripper 52 of the cassette by hand in a direction Y (FIG. 1) opposite to the cassette inserting direction X.

At the initial phase of the cassette retracting operation, the both left and right ends 61L, 61R of the pressurizing shaft 61 of the cassette 50 are disengaged from the cam grooves 45*a*, 45*b* formed in the inner surfaces of the left and right pedestals 31L, 31R of the feeder 30 to release the pressurizing shaft 61, with the result that the anti-clockwise biasing force acting on the pressurizing levers 59, 60 is relieved. Consequently, the pressurizing levers 59, 60 are rotated in the anti-clockwise direction by the weights of the intermediate plate 56 and of the sheet stack P thereon, so that the intermediate plate 56 is laid on the bottom wall of the body case 51 of the cassette as shown in FIG. 11. Further, the pressurizing shaft 61 is also lifted up to the upper ends of the slots 62 in which the shaft is received. Since the lever extensions 70 are rested on the pressurizing shaft 61 returned to the upper ends of the slots 62, the separating pawls 66 are held at the horizontal rest position. The variety of information has resulted in the increase in the frequency in use of sheet, and cassettes having the greater sheet stacking ability than that of the conventional cassettes have been proposed. Thus, although the trouble regarding the replenishment of the recording sheets was eliminated, when the cassette having the greater sheet stacking ability was mounted in or dismounted from the facsimile system, there arose the problem that the operability was worsened in comparison with the conventional cassette.

In comparison with the conventional cassette (250 sheets containable) and the cassette (500 sheets containable) according to the present invention, the following data could be obtained:

The weight of regular sheet (having a weight 64 g/m$^2$) is 4.5 grams per one sheet, and thus, 250 sheets: 4.5 g×250=1,125 g=about 1.13 kg, 500 sheets: 4.5 g×500=2,250 g=2.25 kg; and, the total weight of the sheet supply cassette (weight of the sheets and weight of the cassette) became as follows:

cassette containing 250 sheets: 2.2 kg, cassette containing 500 sheets: 3.8 kg.

Further, the urging force for maintaining the sheet supplying ability became as follows:

as cassette containing 250 sheets:

1.5 kgf–2.0 kgf, as cassette containing 500 sheets:

5.0 kgf–6.0 kgf.

Further, by mounting and dismounting the cassette 50 with respect to the same feeder 30, when the mounting and dismounting force for mounting and dismounting the cassette with respect to the feeder was measured, the following values could be obtained:

as cassette containing 250 sheets:

3.0 kgf–3.5 kgf, as cassette containing 500 sheets:

6.5 kgf–7.0 kgf.

As apparent from the above, the mounting and dismounting force for the cassette of the present invention is greater, by twice, than that for the conventional cassette.

Now, in the present invention, the following three items are considered as the causes for increasing the mounting and dismounting force:

(1) a load of the sheet supply cassette 50 containing 500 sheets therein;

(2) a sliding resistance force between the left and right elongated flanges 55L, 55R of the cassette and the cassette guide grooves 43 of the feeder while the sheet supply cassette 50 is being inserted into and dismounted from the feeder 30; and (3) a sliding resistance force generated while the pressurizing shaft protruded outwardly from the left and right side walls **51*b*, 51*c* of the sheet supply cassette 50 is being lowered along the cam grooves 45*a*, 45*b* formed in the inner surfaces of the left and right pedestals 31L, 31R of the sheet feeder 30 from their upper ends to their lower ends (a sliding resistance load between the pressurizing shaft 61 and the inclined slots 62 formed symmetrically in the left and right side walls 51*b*, 51*c* of the body case 51** while the pressurizing shaft is being slid along the slots).

As to the above item (1), in order to maintain the sheet supplying ability of the sheet supply cassette 50 according to the present invention, in consideration of the fact that the weight of the sheets (2.25 kg) is a physical value, tests for determining whether the sliding resistance forces (as considered in the above items (2) and (3)) generated during the mounting and dismounting of the cassette 50 can be reduced or not were effected. As a result, it was theoretically found that, by reducing the coefficients of friction of the cassette guide grooves 43 of the feeder, the elongated flanges 55L, 55R protruded outwardly from the sheet supply cassette along its longitudinal direction and the inclined slots 62 symmetrically formed in the left and right side walls **51*b*, 51*c* of the sheet supply cassette 50**, the mounting and dismounting force for the cassette could be reduced to substantially the same extent as that for the conventional cassette containing 250 sheets. In fact, it was found that the mounting and dismounting force for the cassette could be reduced to 4.5–5.0 kgf by mirror-finishing the above elements (by polishing with a paper file of #2000) after these elements were molded from resin.

Further, by coating the low friction resin material such as 4-fluoride resin on these elements or by adhering a sheet made of such low friction material to these elements or by making the sheet supply cassette 50 and the pedestals 31L, 31R of the feeder 30 from 4-fluoride resin, the mounting and dismounting force for the cassette could be reduced to 3.5–4.0 kgf, which is the same as that for the conventional cassette containing 250 sheets. Further, in place of the above-mentioned low friction material, as an alternative method for reducing the sliding resistance forces, rollers may be arranged in the cassette guide grooves 43 of the feeder and the cassette may be slid on such rollers, or rolling bearings may be provided on the pressurizing shaft 61 sliding in the inclined slots 62 formed symmetrically in the left and right side walls **51*b*, 51*c* of the sheet supply cassette 50 to reduce the sliding resistance force between the shaft and the slots 62**.

As mentioned above, the sheet supplying apparatus A according to the present invention is so constructed that, even when the user buys such apparatus additionally and optionally at need, it can easily be incorporated into and used with the existing system B such as copying machine, facsimile and the like. Further, the sheet supply rollers 37 of the feeder 30 are formed as the semi-cylindrical rollers to permit the insertion of the sheet supply cassette 50 for a long distance, thereby containing the sheet supplying apparatus A within the system B at the lower portion thereof completely. Since the sheet supplying direction for the sheets stacked in the cassette 50 mounted within the feeder 30 is opposite to the cassette inserting direction with respect to the feeder 30, by retracting the cassette from the system B at the left side thereof, the jam treatment can easily be effected without the trouble that the operator must go to the back side of the system for performing the jam treatment.

The reason why the jam treatment and other operations can be effected at the left side of the system B in spite of the fact that the sheet supplying apparatus A comprising the feeder 30 and the cassete 50 is completely confined within the lower portion of the facsimile system B by using the long distance insertion stroke is that the sheets in the cassette are supplied in the direction opposite to the cassette inserting direction with respect to the feeder 30 in spite of the long distance insertion stroke of the cassette 50. Further, since the sheet supplying apparatus A comprising the feeder 30 and the cassette 50 is completely confined within the lower portion of the facsimile system B, only the cassette 50 is subjected to the design modification regarding its height to permit the stacking of a greater number of sheets P, and the design modification of the facsimile system B is not required at all. That is to say, the design modification can easily be effected, and the versatility for the specification can be extended.

In the case where the cassette is inserted in a direction same as the sheet supplying direction as in the conventional technique, it was feared that the leading ends of some sheets among the sheet stack contained in the cassette were protruded outwardly from the cassette due to the inertia force caused by the shock generated at the end of insertion of the cassette, or the separating pawls were subjected to the strong force to be deformed or be operated poorly (in case of the cassettes having the separating pawls). However, when the cassette is inserted in the direction opposite to the cassette supplying direction as in the present invention, since the above-mentioned inertia force acts reversely, the above-mentioned trouble do not occur.

Incidentally, the sheet convey rollers 71 of the cassette 50 may be constituted as driving rollers as same as the feed rollers 40 of the feeder 30.

As mentioned above, by extending the adjustment range of the urging force for biasing the intermediate plate on which the sheets are stacked upwardly, it is possible to supply the sheets from the sheet containing portion without fail, regardless of the number of the stacked sheets.

Next, a second embodiment of the present invention will be explained.

Incidentally, in this second embodiment, since only the construction of a cassette differs from that of the above-mentioned first embodiment, the construction of the cassette will be mainly explained while being stacked on the intermediate plate 56.

The reference numeral 59 (FIGS. 7 and 11) denotes L-shaped pressurizing levers for rocking the intermediate plate 56 in the up-and-down direction. The pressurizing levers 59 are pivotally mounted on a shaft 59*a* disposed ahead of the front end of the intermediate plate 56, and horizontal arms 59*b* of the levers 59 are disposed below the front end of the intermediate plate 56 so that, when the pressurizing levers 59 are rotated around the shaft 59*a* in counterclockwise direction, the horizontal arms 59*b* are cocked to rotate the intermediate plate 56 around the pins 56*a* in the upward direction. Free end portions of the horizontal arms of the pressurizing levers 59 are constituted by low friction resin material such as oleo-plastic or 4-fluoride resin so as to minimize the sliding resistance between the pressurizing levers 59 and the intermediate plate 56, so that the pressurizing force from the pressurizing levers 59 can be effectively transmitted to the intermediate plate 56.

A pressurizing shaft 61 disposed ahead of the pressurizing levers 59, 60 has left and right ends 61L, 61R fitted into vertical and inclined slots 62 formed symmetrically in left and right side walls 51*b*, 51*c* of the body case 51, respectively; the left and right ends 61L, 61R of the shaft 61 are protruded outwardly from the left and right side walls 51*b*, 51*c* (FIGS. 9 and 10). Tension coil springs 63, 65 are connected between the pressurizing shaft 61 and vertical arms 59*c*, 60*c* of the levers 59, 60. In a condition that the sheet supply cassette 50 is dismounted from the sheet feeder 30 (FIG. 24), the pressurizing levers 59 are biased to be rotated around the shaft 59*a* in the clockwise direction by the weight of their horizontal arms 59*b* so that the horizontal arms 59*b* are laid substantially in the horizontal plane. In this condition, the pressurizing shaft 61 is subjected to a tension force from the vertical arms 59*c* of the pressurizing levers 59 via the coil springs 63 so that the left and right ends 61L, 61R of the shaft are lifted up to upper ends of the slots 62 and are held there.

Figure 28:
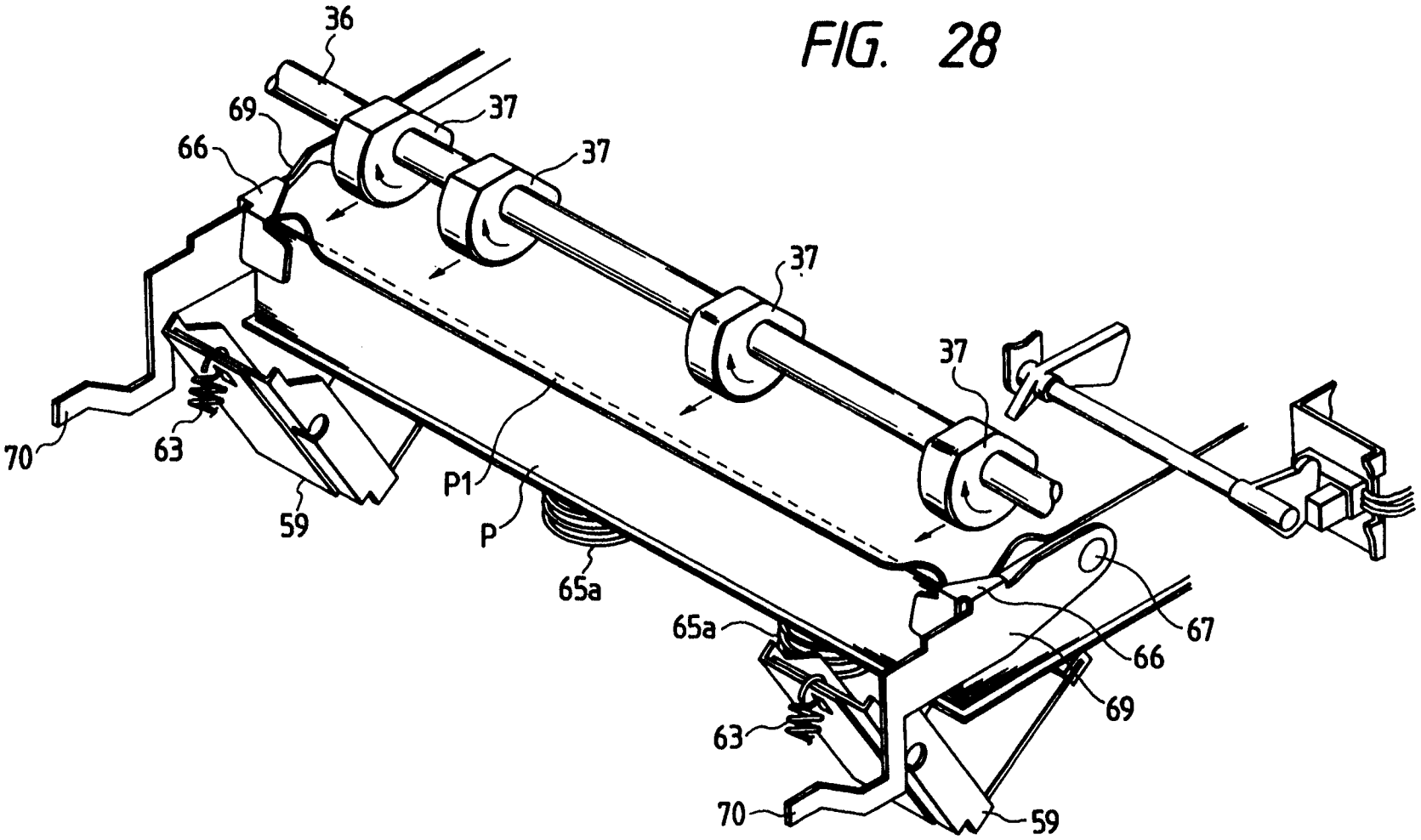
FIG. 28 is a view for explaining a condition that the sheets are separated one by one.
Figure 29:
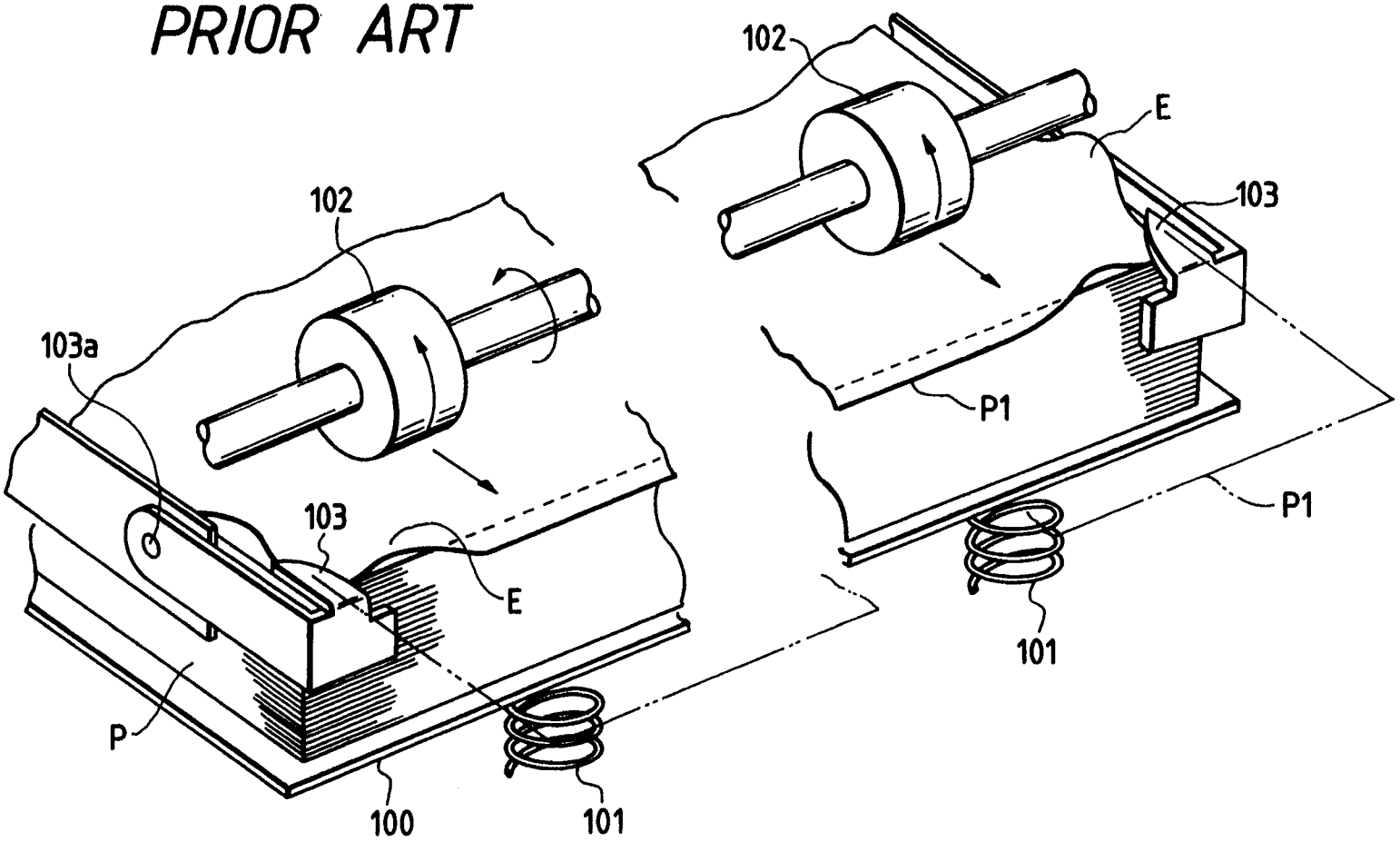
FIG. 29 PRIOR ART
FIG. 29 is a perspective view of a conventional sheet supply cassette.

The reference numeral 65*a* denotes compression coil springs (second pressurizing members) for directly pressurizing the intermediate plate 56. The forces of the compression coil springs 65*a* are so selected that, when there is no sheet P on the intermediate plate 56, the weight of the intermediate plate is well balanced with the spring forces during the pivotal movement of the plate. FIG. 28 is a perspective view showing a mechanism for lifting the intermediate plate 56.

Figure 24:
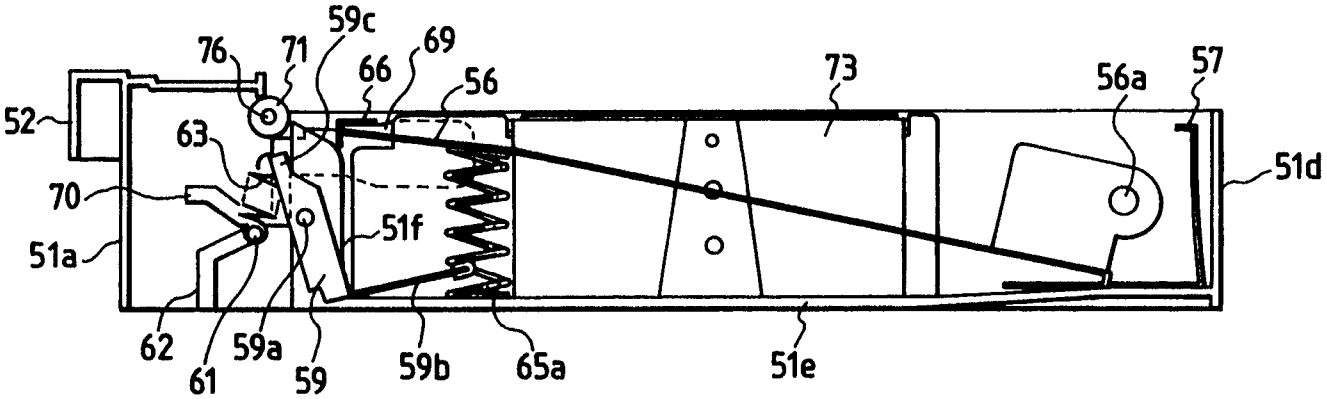
FIG. 24 is an elevational sectional view of the sheet supply cassette of FIG. 23.
Figure 25:
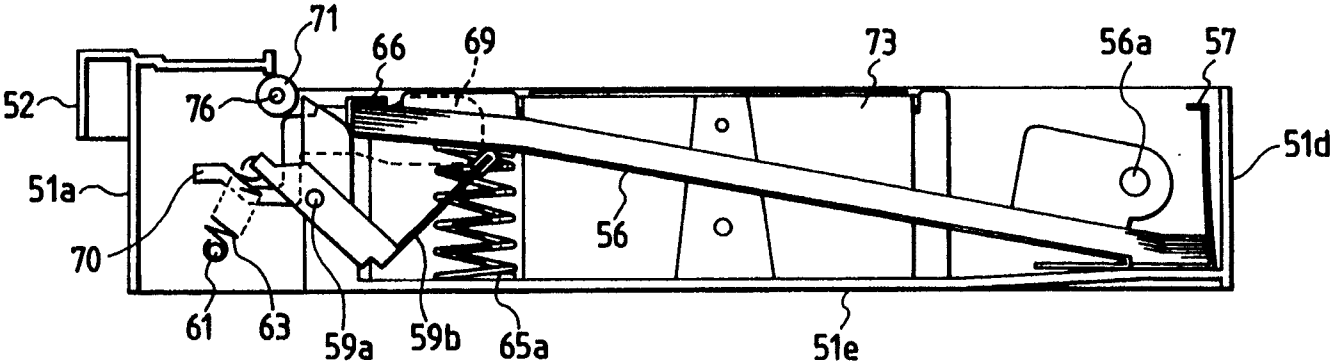
FIG. 25 is an elevational sectional view for explaining an operation of the sheet supply cassette.

In the condition that the cassette 50 is dismounted from the feeder 30 as shown in FIG. 24, the cassette is balanced with the urging forces of the compression coil springs 65*a*. Further, the separating pawls 66 are positioned and held within the body case 51 near the upper opening thereof since the lever extensions 70 of the pivot levers 69 having the separating pawls are rested on the pressurizing shaft 61 held at the top ends of the inclined slots 62 to position the levers 69 in the horizontal rest position and to prevent the further downward pivotal movements of the levers. Accordingly, in loading the sheets P in the body case 51, when the sheets P are rested on the intermediate plate 56, the weight of the sheets P lowers the intermediate plate 56 in opposition to the biasing forces of the compression coil springs 65*a*. Thus, the sheet loading or stacking operation can be effected easily and quickly without lowering the intermediate plate 56 by hand.

Incidentally, in the case of the conventional cassette as shown in FIG. 31, the separating pawls 103 urged upwardly and held at the uppermost position by the leading end of the intermediate plate 100 or the leading end of the sheet stack rested on the intermediate plate which is always biased upwardly by the springs 101. Accordingly, when the new sheets P are replenished or loaded in a body case (not shown), since the operator must replenish the sheets P in the body case while pushing down the intermediate plate 100 in opposition to the springs 101 by hand and without interfering the leading ends of the sheets P with the separating pawls 103, the operability for replenishing the sheets P in the cassette was worsened. To the contrary, the cassette 50 according to the present invention can eliminate this inconvenience, as mentioned above.

Figure 26:
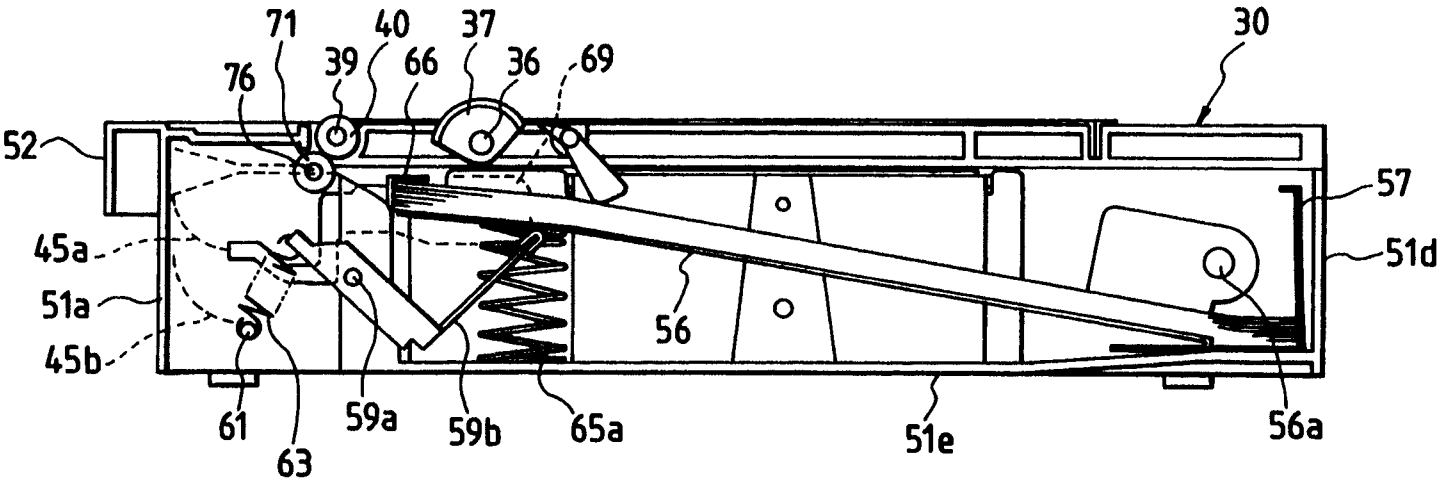
FIG. 26 is an elevational sectional view showing a condition that the sheet supply cassette was mounted on the sheet feeder.

Now, the function of the cassette 50 will be explained. FIG. 26 shows a condition that the cassette 50 is mounted in the feeder 30.

As the amount of the sheets stacked in the cassette 50 is decreased, the intermediate plate 56 are gradually rotated upwardly since the pressurizing levers 59 are gradually rotated in the anti-clockwise direction by the charging forces of the tension coil springs 63. In this respect, with respect to the conventional sheet supply cassette having the maximum sheet stacking ability of 250 sheets, as the intermediate plate 56 was being rotated upwardly around the pins 56*a* due to the anti-clockwise rotation of the pressurizing levers 59 around the pins 59*a*, the sheet supply pressure was in the order of 300–400 grams through the first to 250th sheets. However, regarding the cassette having the maximum sheet stacking ability of 500 sheets, when the sheet supply pressure was measured, the result as shown in FIG. 30 was obtained. That is to say, the sheet supply pressure regarding the first sheet was 300 grams, 250th sheet 730 grams and 500th sheet 300 grams, which resulted in the non-uniform distribution of the sheet supply pressure not to provide the stable sheet supply pressure. Thus, when the thicker sheets or thin sheets were used, undesirable phenomena such as the poor sheet supply, skew-feed, double-feed and the like occurred.

Figure 27:
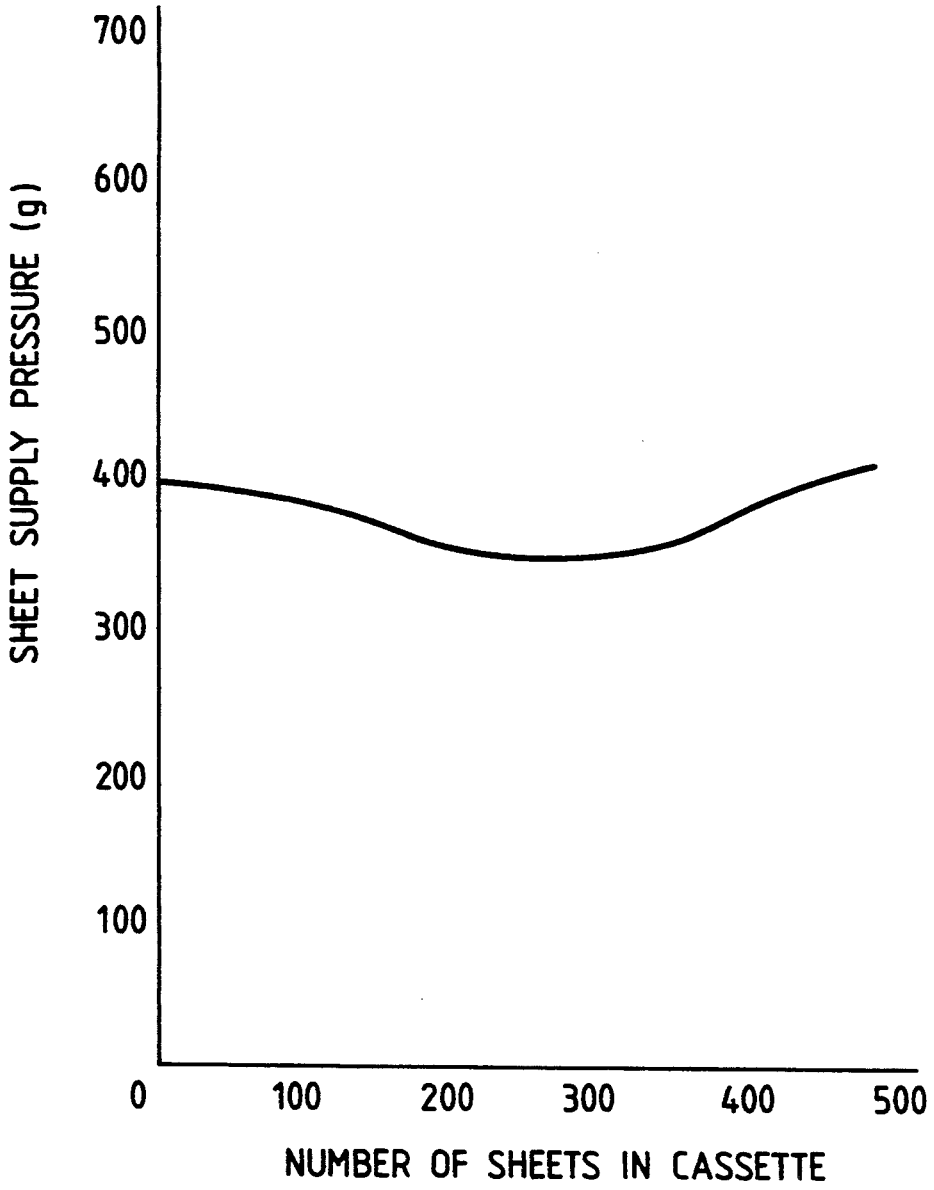
FIG. 27 is a graph showing a relationship between a sheet stacking amount and a sheet supply pressure, according to the second embodiment.

Thus, to-provide a stable sheet supply pressure, according to the embodiment of the present invention, two tension springs 63 acting as the first pressurizing members are arranged at both ends of the body case 51, respectively, and two compression coil springs 65*a* acting as the second pressurizing members are arranged within the body case 51. The tension coil springs 63 arranged at the both ends of the body case 51 are set in the same manner as the conventional cassette having the maximum stacking ability of 250 sheets, and, in addition to these springs, the second pressurizing members 65*a* are additionally provided at both ends within the body case 51. That is, according to the embodiment of the present invention, the pressurizing members are divided into two (two tension springs and two compression springs) so that the spring forces of the pressurizing members are dispersed. As a result, as shown in FIG. 27, the distribution of the sheet supply pressure regarding the cassette having the maximum sheet stacking ability of 500 sheets becomes substantially the same as that of the conventional cassette having the maximum sheet stacking ability of 250 sheets, thus maintaining the sheet supply pressure at a constant level within 300–500 grams.

As mentioned above, the intermediate plate is maintained to the pivotable condition by receiving the urging forces from the first and second pressurizing members in the sheet supplying condition, and is subjected to the urging forces only from the second pressurizing members by releasing the force transmission from the first pressurizing members in the non-sheet supplying condition. However, the second pressurizing members are balanced with the weight of the intermediate plate when there is no sheet on the plate. Accordingly, when the sheets are replenished in the sheet containing portion, the intermediate plate can be lowered by the weight of the sheet to be replenished and then is balanced with the second pressurizing members again at a new position; therefore, in replenishing the sheets, since there is no upward resistance from the intermediate plate and there is no interference between the sheets and the separating pawls, the replenishment of the sheets can be effected easily and quickly. Further, even when the number of the stacked sheets is increased, the operability regarding the replenishment of the sheets, trouble treatments such as the jam treatment and the exchange of sheets is not deteriorated.

What is claimed is:

1. A sheet supplying apparatus, comprising:

sheet supporting means for supporting sheets; and sheet supplying means for feeding out a sheet supported on said sheet supporting means by applying a feeding force to the sheet;

said sheet supporting means comprising a shiftable sheet support member on which an amount of the sheets are stacked, and pressurizing means for biasing said sheet support member toward said sheet supplying means, said pressurizing means including a plurality of pressure members so disposed that they are selectively used in response to the amount of the sheets stacked on said sheet support member to thereby maintain a pressure between said sheet supplying means and the sheet within a predetermined range for feeding out the sheet.

2. A sheet supplying apparatus according to claim 1, wherein a number of said pressure members used for biasing said sheet support member is decreased in accordance with a decrease in the amount of sheets stacked in said sheet support member.

3. A sheet supplying apparatus according to claim 2, wherein said sheet supporting means is a sheet cassette and said sheet support member is an intermediate plate disposed in said sheet cassette, and said intermediate plate has one end pivotally supported and the other end biased toward said sheet supplying means by said pressurizing means.

4. A sheet supplying apparatus according to claim 3, wherein each of said pressure members comprises a pivotable lever having one end abutted against said intermediate plate and the other end connected to an elastic member, whereby said intermediate plate is biased toward said sheet supplying means by an elastic force of said elastic member.

5. A sheet supplying apparatus according to claim 4, wherein said plurality of pressure members comprise levers having different lengths, and, when the amount of sheets stacked on said sheet support member is great, all of said pressure members bias said sheet support member, and, as the amount of sheets stacked on said sheet support member is decreased, only the pressure members having long levers bias said sheet support member.

6. A sheet supplying apparatus according to claim 4, further comprising guide means for inserting and retracting said sheet cassette with respect to a sheet supplying position where the sheet is supplied by said sheet supplying means.

7. A sheet supplying apparatus according to claim 6, further comprising switching means for switching said plurality of pressure members between a condition in which said pressure members do not bias said sheet support member when said sheet supporting means is retracted from said sheet supplying position and a condition in which said pressure members bias said sheet support member in response to the insertion of said sheet supporting means into said sheet supplying position.

8. A sheet supplying apparatus according to claim 7, wherein said switching means comprises a cam surface formed on said guide means, and a follower provided at one end of said elastic member and shiftable along said cam surface to displace said elastic member in a direction for charging the elastic force.

9. A sheet supplying apparatus, comprising:

sheet containing means for containing sheets, said sheet containing means removably mounted onto a body of said apparatus; and sheet supplying means for feeding out a sheet contained in said sheet containing means by applying a feeding force to the sheet;

said sheet containing means further comprising a shiftable sheet support member on which the sheets are stacked, and pressurizing means for biasing said sheet support member on which the sheets are stacked toward said sheet supplying means, and said pressurizing means further comprising first pressurizing means for continuously biasing said sheet support member, and second pressurizing means capable of being switched between a biasing condition and a non-biasing condition in response to the mounting of said sheet containing means onto said apparatus.

10. A sheet supplying apparatus according to claim 9, wherein said second pressurizing means bias said sheet support member when said sheet containing means is mounted onto said apparatus, and does not bias said sheet support member when said sheet containing means is not mounted onto said apparatus.

11. A sheet supplying apparatus according to claim 10, wherein a biasing force of said first pressurizing means is balanced with a weight of said sheet support member and sheets.

12. A sheet supplying apparatus according to claim 11, wherein said first pressurizing means comprises a coil spring.

13. A sheet supplying apparatus according to claim 10, wherein said sheet support member is an intermediate plate which has one end pivotally supported and the other end biased toward said sheet supplying means by said pressurizing means.

14. A sheet supplying apparatus according to claim 13, wherein said second pressurizing means comprise a pivotable lever having one end abutted against said intermediate plate and the other end connected to an elastic member, whereby said intermediate plate is biased toward said sheet supplying means by an elastic force of said elastic member.

15. A sheet supplying apparatus according to claim 14, further comprising guide means for inserting and retracting said sheet containing means with respect to a sheet supplying position where the sheet is supplied by said sheet supplying means.

16. A sheet supplying apparatus according to claim 15, further comprising switching means for switching said pressurizing means between a condition in which said second pressurizing means do not bias said sheet support member when said sheet containing means is retracted from said sheet supplying position and a condition in which said second pressurizing means bias said sheet support member in response to the insertion of said sheet containing means into said sheet supplying position.

17. A sheet supplying apparatus according to claim 16, wherein said switching means comprises a cam surface formed on said guide means, and a follower provided at one end of said elastic member and shiftable along said cam surface to displace said elastic member in a direction for charging the elastic force.

18. An image forming system, comprising:

sheet supporting means for supporting an amount of sheets;

sheet supplying means for feeding out a sheet supported on said sheet supporting means by applying a feeding force to the sheet; and image forming means for forming an image on the sheet fed out by said sheet supplying means;

said sheet supporting means including a shiftable sheet supporting member on which the sheets are stacked and pressurizing means for biasing said sheet supporting member toward said sheet supplying means; and said pressurizing means including a plurality of pressure members so disposed that they are selectively used in response to the amount of the sheets stacked on said sheet support member to thereby maintain a pressure between the sheet and said sheet supplying means within a predetermined range for feeding out the sheets.

19. An image forming system according to claim 18, wherein a number of said pressure members used for biasing said sheet supporting member is decreased in accordance with a decrease in the amount sheets stacked in said sheet containing means.

20. An image forming system, comprising:

sheet containing means for containing sheets, said sheet containing means removably mountable onto a body of an image forming apparatus;

sheet supplying means for feeding out the sheet contained in said sheet containing means by applying a feeding force to the sheet; and image forming means for forming an image on the sheet fed out by said sheet supplying means;

said sheet containing means comprising a shiftable sheet support member on which the sheets are stacked and pressurizing means for biasing said sheet support member toward said sheet supplying means: and said pressurizing means comprising first pressurizing means for continuously biasing said sheet support member, and second pressurizing means capable of being switched between a biasing condition and a non-biasing condition in response to the mounting of said sheet containing means onto said apparatus.

21. An image forming system according to claim 20, wherein said second pressurizing means bias said support member when said sheet containing means is mounted onto the apparatus and do not bias said sheet support member when said sheet containing means is not mounted onto said apparatus.

22. A sheet supplying apparatus, comprising:

sheet supporting means for supporting an amount of sheets;

sheet feeding means for feeding out a sheet supported on said sheet supporting means; and biasing means for biasing said sheet supporting means on which the sheets are stacked toward said sheet feeding means;

wherein said biasing means comprises a plurality of bias members so disposed that they are selectively used in response to the amount of sheets stacked on said sheet supporting means to thereby maintain a pressure between the sheet and said sheet feeding means within a predetermined range for feeding out the sheet.

23. A sheet supplying apparatus according to claim 22, wherein a number of said biasing means is decreased in accordance with a decrease in the sheets supported in said sheet supporting means.

24. An image forming apparatus, comprising:

sheet supporting means for supporting an amount of sheets;

sheet feeding means for feeding out a sheet supported on said sheet supporting means;

image forming means for forming an image on the sheet fed out by said sheet feeding means; and biasing means for biasing said sheet supporting means on which sheets are stacked toward said sheet feeding means;

wherein said biasing means comprises a plurality of bias members so disposed that they are selectively used in response to the amount of sheets stacked on said sheet supporting means to thereby maintain a pressure between the sheet and said sheet feeding means within a predetermined range for feeding out the sheet.

25. A sheet supplying apparatus, comprising:

sheet supporting means removably mounted onto said sheet supplying apparatus for supporting sheets;

sheet feeding means for feeding out sheets supported on said sheet supporting means; and a plurality of biasing means for biasing said sheet supporting means on which the sheets are stacked toward said sheet feeding means;

said plurality of biasing means comprising first biasing means for continuously biasing said sheet supporting means toward said sheet feeding means and second biasing means switchable between a biasing condition and a non-biasing condition in response to mounting of said sheet supporting means onto said apparatus.

26. A sheet supplying apparatus according to claim 25, wherein said second biasing means biases said sheet supporting means when said sheet supporting means is mounted onto said apparatus and, does not bias said sheet supporting means when said sheet supporting means is not mounted onto said apparatus.

27. An image forming apparatus, comprising:

sheet supporting means removably mounted onto said image forming apparatus for supporting sheets;

sheet feeding means for feeding out sheets supported on said sheet supporting means;

image forming means for forming an image on the sheet fed out by said sheet feeding means; and a plurality of biasing means for biasing said sheet supporting means on which the sheets are stacked toward said sheet feeding means;

wherein said plurality of biasing means comprises first biasing means for continuously biasing said sheet supporting means toward said sheet feeding means and second biasing means switchable between a biasing condition and a non-biasing condition in response to mounting of said sheet supporting means onto said apparatus.

* * * * *

UNITED STATES PATENT AND TRADEMARK OFFICE

CERTIFICATE OF CORRECTION

PATENT NO. : 5,398,108
DATED : March 14, 1995
INVENTOR(S) : KAZUYUKI MORINAGA, ET AL.

It is certified that error appears in the above-indentified patent and that said Letters Patent is hereby corrected as shown below:

Column 7,
line 59, "to" (first occurrence) should be deleted.
Column 12,
line 30, "does" should read --is--.
Column 17,
line 36, "a" should be deleted.
Column 20,
line 29, "g ± 6g" should read --g ± 6g."--; and
line 38, "no" should read --any--.
Column 23,
line 23, "do" should read --does--.
Column 28,
line 9, "amount" should read --amount of--; and
line 15, "sheet" (seecond occurrence) should read --sheets--.

Signed and Sealed this

Eleventh Day of July, 1995

Bruce Lehman

*Attest:*

BRUCE LEHMAN

*Attesting Officer*

*Commissioner of Patents and Trademarks*